US009375736B2

(12) United States Patent
Kaneko et al.

(10) Patent No.: US 9,375,736 B2
(45) Date of Patent: Jun. 28, 2016

(54) SPRAY GUN

(71) Applicant: ANEST IWATA CORPORATION, Yokohama-shi, Kanagawa (JP)

(72) Inventors: Masaru Kaneko, Fujisawa (JP); Shozo Kosaka, Yokohama (JP); Nobuhiro Sawata, Yokohama (JP); Hirohide Sugiyama, Zushi (JP)

(73) Assignee: ANEST IWATA CORPORATION, Yokohama (JP)

( * ) Notice: Subject to any disclaimer, the term of this patent is extended or adjusted under 35 U.S.C. 154(b) by 582 days.

(21) Appl. No.: 13/687,614

(22) Filed: Nov. 28, 2012

(65) Prior Publication Data

US 2014/0034757 A1 Feb. 6, 2014

(30) Foreign Application Priority Data

Aug. 3, 2012 (JP) ..... 2012-173256

(51) Int. Cl.
*B05B 7/06* (2006.01)
*B05B 7/08* (2006.01)

(52) U.S. Cl.
CPC ..... *B05B 7/066* (2013.01); *B05B 7/0815* (2013.01)

(58) Field of Classification Search
CPC ..... B05B 7/06; B05B 7/062; B05B 7/066; B05B 7/12; B05B 7/08; B05B 7/0807; B05B 7/0815
USPC ..... 239/292, 296–301, 407, 408, 413–415, 239/416, 416.4–417.5, 418, 420, 239/423–424.5, 526
See application file for complete search history.

(56) References Cited

U.S. PATENT DOCUMENTS

| | | | |
|---|---|---|---|
| 1,751,787 | A | 3/1930 | Binks |
| 2,646,314 | A | 7/1953 | Peeps |
| 3,583,632 | A | 6/1971 | Shaffer et al. |
| 3,746,253 | A | 7/1973 | Walberg |
| 3,747,850 | A | 7/1973 | Hastings et al. |

(Continued)

FOREIGN PATENT DOCUMENTS

| | | | |
|---|---|---|---|
| EP | 0 092 392 | A2 | 10/1983 |
| EP | 0 650 766 | B1 | 4/1999 |

(Continued)

OTHER PUBLICATIONS

Rone, William S. et al. "MEMS-Based Microdroplet Generation with Integrated Sensing". Excerpt from the Proceedings of the 2011 COMSOL Conference in Boston, Exhibit 2018 in IPR2013-00111.

(Continued)

*Primary Examiner* — Christopher Kim
(74) *Attorney, Agent, or Firm* — Oliff PLC

(57) ABSTRACT

Disclosed is a spray gun, including a gun main body, a coating material nozzle attached to a gun barrel part of the gun main body and formed with at least one groove on a tip end portion having a coating material ejection opening; and an air cap disposed surrounding the coating material ejection opening of the coating material nozzle, introducing air to the at least one groove of the coating material nozzle, and having a side air hole for ejecting air to intersect with coating material ejected from the coating material ejection opening of the coating material nozzle, wherein the coating material nozzle is configured to adjust a position of the at least one groove around a central axis thereof at least at the tip end portion thereof.

3 Claims, 12 Drawing Sheets

(56) References Cited

U.S. PATENT DOCUMENTS

| | | | | |
|---|---|---|---|---|
| 3,857,511 | A | 12/1974 | Govindan | |
| 3,873,023 | A | 3/1975 | Moss et al. | |
| 4,273,293 | A | 6/1981 | Hastings | |
| 4,884,742 | A | 12/1989 | Bekius et al. | |
| 5,064,119 | A | 11/1991 | Mellette | |
| 5,078,323 | A | 1/1992 | Frank | |
| 5,080,285 | A | 1/1992 | Toth | |
| 5,088,648 | A | 2/1992 | Schmon | |
| 5,090,623 | A | 2/1992 | Burns et al. | |
| 5,249,746 | A | 10/1993 | Kaneko et al. | |
| 5,344,078 | A | 9/1994 | Fritz et al. | |
| 5,435,491 | A * | 7/1995 | Sakuma | 239/296 |
| 5,456,414 | A | 10/1995 | Burns et al. | |
| 5,540,385 | A | 7/1996 | Garlick | |
| 5,607,108 | A | 3/1997 | Garlick et al. | |
| 5,613,637 | A | 3/1997 | Schmon | |
| 5,941,461 | A | 8/1999 | Akin et al. | |
| 5,992,763 | A | 11/1999 | Smith et al. | |
| 6,494,387 | B1 | 12/2002 | Kaneko | |
| 6,708,900 | B1 | 3/2004 | Zhu et al. | |
| 7,163,160 | B2 | 1/2007 | Liu | |
| 8,225,892 | B2 | 7/2012 | Ben-Tzvi | |
| 2005/0145718 | A1 | 7/2005 | Blette et al. | |

FOREIGN PATENT DOCUMENTS

| | | | |
|---|---|---|---|
| EP | 1 108 476 | A1 | 6/2001 |
| JP | S58-119862 | U | 8/1983 |
| JP | S61-55951 | U | 4/1986 |
| JP | H01-77863 | U | 5/1989 |
| JP | H06-304501 | A | 11/1994 |
| JP | A-08-196950 | | 8/1996 |
| JP | 2002-001169 | A | 1/2002 |
| JP | 2010-502419 | A | 1/2010 |
| JP | 2014-033993 | A | 2/2014 |
| WO | WO 01/02099 | A1 | 1/2001 |
| WO | 2008/029229 | A1 | 3/2008 |
| WO | 20081029229 | A1 | 3/2008 |

OTHER PUBLICATIONS

Oct. 11, 2013 Larimer Deposition, Exhibit 2021 in IPR2013-00111.
Oct. 14, 2013 Schmon Deposition, Exhibit 2022 in IPR2013-00111.
Oct. 15, 2013 BenTzvi Deposition, Exhibit 2023 in IPR2013-00111.
Oct. 17, 2013 Akafuah Deposition, Exhibit 2024 in IPR2013-00111.
Certified translation of JP 8-196950 (Exhibit 1020 in IPR2013-00111).
Oct.-Dec. 1996 SATA News Publication Dan-Am, Exhibit 1035 in IPR2013-00111.
Dec. 9, 2013 Demonstrative 1, Substitute Claim 23, Exhibit 2025 from IPR2013-00111.
Dec. 9, 2013 Demonstrative 2, From pp. 44-46 of the transcript of the deposition of Nelson Akafuah, Exhibit 2026 in IPR2013-00111.
Extended European Search Report issued in European Patent Application No. 13179078.4 on Nov. 18, 2013.
Jan. 6, 2015 Office Action issued in Japanese Patent Application No. 2012-173526.
Jan. 11, 2013 Petition for Inter Partes Review in IPR2013-00111.
Apr. 10, 2013 Preliminary Response in IPR2013-00111.
May 23, 2013 Decision in IPR2013-00111.
Jun. 6, 2013 Petitioner's Request for Rehearing in IPR2013-00111.
Jun. 25, 2013 Decision on Rehearing in IPR2013-00111.
Jul. 25, 2013 Motion to Amend in IPR2013-00111.
Aug. 8, 2013 Motion to Amend (updated) in IPR2013-00111.
Sep. 30, 2013 Petitioner's Opposition in IPR2013-00111.
Oct. 21, 2013 Reply in IPR2013-00111.
Nov. 11, 2013 Motion to Exclude Evidence in IPR2013-00111.
Nov. 25, 2013 Petitioner's Opposition in IPR2013-00111.
Dec. 2, 2013 Reply to Petitioner's Opposition in IPR2013-00111.
Apr. 9, 2014 Oral Hearing Transcript in IPR2013-00111.
May 20, 2014 Final Written Decision in IPR2013-00111.
Jan. 24, 2013 First drawing based on Fig.2 of JP 8-196950, Exhibit 1003 in IPR2013-00111.
Jan. 24, 2013 Second drawing based on Fig. 2 of JP 8-196950, Exhibit 1004 in IPR2013-00111.
Jan. 24, 2013 Third drawing based on Fig 2 of JP 8-196950, Exhibit 1005 in IPR2013-00111.
Printout from Internet http://www.ehow.com/how_4493101_choose-spray-gun-auto-paint.html obtained Sep. 7, 2012, Exhibit 1023 in IPR2013-00111.
Printout from Internet http://www.bodyshopbusiness.com/Article/3512/common_sense_spraygun_tips.aspx obtained Sep. 7, 2012, Exhibit 1024 in IPR2013-00111.
Printout from Internet Brochure of Walther Pilot, www.walther-pilot.de published Mar. 2007, Exhibit 1025 in IPR2013-00111.
Printout from Internet http://www.alsacorp.com/products/hvlp-sprayguns/ obtained Aug. 26, 2012, Exhibit 1026 in IPR2013-00111.
Printout from Internet p. 28 from current 3M brochure, http://homesteadfinishingproducts.com/wp-content/ uploads/2014/04/34-8701-7283-9-Automatic-Gun-Manual.pdf (2008), Exhibit 1027 in IPR2013-00111.
Sep. 5, 2012 Declaration of Knud Jorgensen, Exhibit 1028 in IPR2013-00111.
Apr. 12, 2012 decision by EPO, Exhibit 1029 in IPR2013-00111.
May 5, 2005 claims in issue in the Opp Proceeding of Exhibit 1029, Exhibit 1030 in IPR2013-00111.
Jan. 24, 2013 Prior art statement showing state-of-the-art in mid 1990s, Exhibit 1031 in IPR2013-00111.
Jul.-Sep. 1996 SATA News Publication Dan-Am, Exhibit 1034 in IPR2013-00111.
Apr.-Jun. 1998 SATA News Publication Dan-Am, Exhibit 1036 in IPR2013-00111.
1991 Dan-Am SATA Catalog 6 for spray guns, Exhibit 1037 in IPR2013-00111.
1994 Dan-Am SATA Catalog 8 for spray guns, Exhibit 1038 in IPR2013-00111.
1991 Dan-Am Catalog pp. 6-51, Exhibit 1042 in IPR2013-00111.
Mar. 1, 1991 JIS B 9809 English translation, Exhibit 1049 in IPR2013-00111.
Mar. 1, 1991 JIS B 9809, Exhibit 1050 in IPR2013-00111.
SATA LM 92 blueprints, SATA Gmbh (1984, 1986, 1990, 1992), Exhibit 1055 in IPR2013-00111.
SATAjet K, SATA Gmbh (1987, 1991, 1992), Exhibit 1056 in IPR2013-00111.
SATA NR 95, SATA Gmbh (1994, 1996), Exhibit 1057 in IPR2013-00111.
SATAjet 90, SATA Gmbh (1989, 1994, 1995, 1996, 1997), Exhibit 1058 in IPR2013-00111.
SATA GRZ, SATA Gmbh (1987, 1992), Exhibit 1059 in IPR2013-00111.
SATAjet B, SATA Gmbh (1980, 1987, 1991, 1992), Exhibit 1060 in IPR2013-00111.
SATAjet H, SATA Gmbh (1983, 1987, 1991), Exhibit 1061 in IPR2013-00111.
Enlarged view of table on p. 4 of SATAjet H (NPL 41), SATA Gmbh (1987), Exhibit 1062 in IPR2013-00111.
Jan. 1, 1995 SATA Gmbh Price list, Exhibit 1063 in IPR2013-00111.
Twist nozzle set with translation and certificate (1973, 1976), Exhibit 1064 in IPR2013-00111.
Sep. 18, 2013 Declaration of Nelson K Akafuah, Exhibit 1065 in IPR2013-00111.
Sep. 20, 2013 Declaration of Pinhas Ben-Tzvi, Exhibit 1066 in IPR2013-00111.
Sep. 23, 2013 Declaration of Anthony Larimer, Exhibit 1067 in IPR2013-00111.
Sep. 24, 2013 Declaration of Dr. Schmon signed, Exhibit 1068 in IPR2013-00111.
Sep. 13, 2013 Excerpted pages from EX2009 Lacovara Transcript, Exhibit 1069 in IPR2013-00111.
"How to Prepare Drawings for Patent Applications in Japan", http://www.jpo.go.jp/toiawase/faq/yokuar10.htm obtained Apr. 9, 2013, Exhibit 2001 in IPR2013-00111.
Jul. 24, 2013 Declaration of Robert R. Lacovara Exhibit 2002 in IPR2013-00111.

(56) References Cited

OTHER PUBLICATIONS

Sep. 25, 2013 Proposed Amendment in IPR2013-00111.
Dec. 18, 2013 Fig. 2 of EX1020 p. 13 marked up by witness Lacovara, Exhibit 2008 in IPR2013-00111.
Sep. 13, 2013 Lacovara Deposition, Exhibit 2009 in IPR2013-00111.
Jan.-Mar. 2009 SATA News, Exhibit 2010 in IPR2013-00111.
SATA Dan-Am Air with Tony Larimer—YouTube, http://www.youtube.com/watch?v=iJtAGIAmSB0 obtained Oct. 9, 2013, Exhibit 2011 in IPR2013-00111.
Sata Spray Guns and Airbrush, http://www.myrideisme.com/Blog/sata-auto-paint-guns-sema/ obtained Oct. 9, 2013, Exhibit 2012 in IPR2013-00111.
How to Set Air Pressure Air Volume—YouTube, http://www.youtube.com/watch?v=HDuuJvyiZi1 obtained Oct. 9, 2013, Exhibit 2013 in IPR2013-00111.
Ohio EPA Letter to Tony Larimer submitted Nov. 11, 2013, Exhibit 2014 in IPR2013-00111.
Ben-Tzvi, Pinhas et al, "A Conceptual Design and FE Analysis of a Piezoceramic Actuated Dispensing System for Microdrops Generation in Microarray Applications". ScienceDirect (2007), Exhibit 2015 in IPR2013-00111.
Printout from Internet, http://www.amazon.com/dispensing-microdrops-generation-medical-A . . . obtained Oct. 14, 2013, Exhibit 2017 in IPR2013-00111.
Jan. 6, 2015 Office Action issued in Japanese Patent Application No. 2012-173256.
Dec. 2, 2014 Office Action issued in Japanese Patent Application No. 2012-177985.
Oct. 31, 2013 Search Report issued in European Application. No. 13179877.9.
Dec. 2, 2014 Office Action issued in Japanese Patent Application. 2012-192467.
Dec. 2, 2014 Office Action issued in Japanese Patent Application No. 2012-176150.
Jan. 6, 2015 Office Action issued in Japanese Patent Application No. 2012-192468.

* cited by examiner

SPRAY GUN

TECHNICAL FIELD

The present invention relates to a spray gun, in particular, improvement of a coating material nozzle thereof.

BACKGROUND ART

For example, Japanese Unexamined Patent Application, Publication No. 1996-196950 (Patent Literature 1), or WO01/02099 (Patent Literature 2) disclose a coating material nozzle of a spray gun, which is formed with, for example, four grooves equiangularly disposed on a periphery of a coating material ejection opening of a coating material nozzle. Each groove is formed to have a cross section of, for example, a V shape, and increases in depth toward a tip of the coating material nozzle.

When the coating material is ejected from the coating material ejection opening of the coating material nozzle, compressed air is introduced to the grooves from a gun main body. The grooves are designed such that the compressed air increases in gas-liquid contact area while passing through the grooves, and then mixes with the ejected coating material by collision. As a result thereof, the compressed air, even if it were in a state of air flow under a low pressure, can be effectively atomized toward a central portion of the ejected coating material.

Furthermore, Japanese Unexamined Patent Application, Publication No. 1996-196950 (Patent Literature 1), and WO01/02099 (Patent Literature 2) disclose an air cap attached to the gun main body disposed around a coating material nozzle of a spray gun. The air cap is formed with a pair of side air holes facing toward each other to have a coating material ejection opening of the coating material nozzle sandwiched therebetween. The compressed air introduced from the gun main body is ejected through the side air holes so that the compressed air intersects with the coating material ejected from the coating material ejection opening. As a result thereof, the coating material ejected from the coating material nozzle can be sprayed in an elliptical spray pattern.

SUMMARY OF INVENTION

Technical Problem

In the spray gun disclosed by Japanese Unexamined Patent Application, Publication No. 1996-196950 (Patent Literature 1), and WO01/02099 (Patent Literature 2), the coating material nozzle is mounted to the gun main body in such a manner that the coating material nozzle formed with a thread groove on an outer periphery thereof is inserted into a hole formed on the gun main body and rotated around a central axis thereof so that the thread groove is screwed with an internal thread groove formed on an inner peripheral surface of the hole.

Such a method of mounting the coating material nozzle to the gun main body may cause a positioning error of the grooves due to machining fluctuation. Accordingly, in the spray gun of prior art, it has been structurally impossible to position the grooves of the tip of the coating material nozzle to a desired position (in a rotational direction of the coating material nozzle).

Furthermore, there has been a drawback that a desired spray pattern cannot be formed if the grooves of the coating material nozzle is not positioned to the desired position (in the rotational direction of the coating material nozzle) appropriate for the elliptical spray pattern of the coating material formed by the compressed air from the side air holes of the air cap.

The present invention has been made in view of the above described drawbacks, and an object thereof is to provide a spray gun that can adjust the position (in the rotational direction of the coating material nozzle) of the grooves of the tip of the coating material nozzle as desired to acquire a desired spray pattern, even after the coating material nozzle is mounted to the gun main body.

Solution to Problem

In order to attain the above described object, the present invention is configured as follows.

In accordance with a first aspect of the present invention, there is provided a spray gun, including a gun main body, a coating material nozzle attached to a gun barrel part of the gun main body and formed with at least one groove on a tip end portion thereof that has a coating material ejection opening, and an air cap disposed surrounding the coating material ejection opening of the coating material nozzle, introducing air to the at least one groove of the coating material nozzle, and having a side air hole for ejecting air to intersect with coating material ejected from the coating material ejection opening of the coating material nozzle. The coating material nozzle is configured to adjust a position of the at least one groove around a central axis thereof at least at the tip end portion thereof.

In accordance with a second aspect of the present invention, according to the first aspect of the spray gun, the at least one groove may include a plurality of grooves provided around the tip end portion of the coating material nozzle and along the circumferential direction of the tip end portion toward the coating material ejection opening.

In accordance with a third aspect of the present invention, according to the first aspect of the spray gun, the coating material nozzle may include a first nozzle arranged on a side of the tip end thereof and a second nozzle arranged coaxially with the first nozzle on a side of a back end thereof. The second nozzle is screwed with the gun main body, and the first nozzle is connected to the second nozzle to adjust the position of the at least one groove around the central axis thereof.

In accordance with a fourth aspect of the present invention, according to the third aspect of the spray gun, the first nozzle may have a large diameter portion in outer diameter formed at a back end portion thereof, and the second nozzle may include an edge wall portion formed with a hole at an open end of a tip end portion thereof. The first nozzle may be connected to the second nozzle in a manner that the edge wall portion of the second nozzle is clamped between the large diameter portion of the first nozzle and a fastener member screwed with a tip end portion of the first nozzle protruding through the hole of the second nozzle.

In accordance with a fifth aspect of the present invention, according to the third aspect of the spray gun, the first nozzle may have at a back end portion thereof a large diameter portion in outer diameter. The second nozzle may have an engaging portion for engaging the large diameter portion of the first nozzle inserted from a back end portion of the second nozzle and an internal thread groove formed on an inner peripheral surface adjacent to the engaging portion. The first nozzle may be connected to the second nozzle in a manner that a ring shaped member formed with a thread groove on an outer periphery is screwed with the internal thread groove of the second nozzle to press the large diameter portion of the first nozzle to the engaging portion of the second nozzle.

In accordance with a sixth aspect of the present invention, according to the fifth aspect of the spray gun may further include a slip ring arranged between the large diameter portion of the first nozzle and the ring shaped member.

In accordance with a seventh aspect of the present invention, according to the third aspect of the spray gun, the first nozzle may have a large diameter portion in outer diameter formed at a back end portion of an extension portion extending from a back end portion of the first nozzle in longitudinal direction along an inner peripheral surface of the second nozzle. The first nozzle may be connected to the second nozzle in a manner that the large diameter portion of the first nozzle is clamped between a back end portion of the second nozzle and the gun main body.

In accordance with a eighth aspect of the present invention, according to the seventh aspect of the spray gun may further include a slip ring arranged around the extension portion and between the back end portion of the second nozzle and the large diameter portion of the first nozzle.

In accordance with a ninth aspect of the present invention, according to the third aspect of the spray gun, the first nozzle may have a large diameter portion in outer diameter at a back end portion thereof. The second nozzle may include an engaging portion for engaging the large diameter portion of the first nozzle inserted from a back end portion thereof. The first nozzle is connected to the second nozzle in a manner that a push washer is inserted from the back end portion of the second nozzle to press the large diameter portion of the first nozzle to the engaging portion of the second nozzle.

In accordance with a tenth aspect of the present invention, according to the ninth aspect of the spray gun may further include a slip ring arranged between the push washer and the large diameter portion of the first nozzle.

In accordance with a eleventh aspect of the present invention, according to the ninth aspect of the spray gun may further include a spring intervening between the push washer and the large diameter portion of the first nozzle.

In accordance with a twelfth aspect of the present invention, according to the eleventh aspect of the spray gun may further include a slip ring arranged between the push washer and the spring.

In accordance with a thirteenth aspect of the present invention, according to the third aspect of the spray gun, the second nozzle may have a large diameter portion in inner diameter at a tip end portion thereof via a step portion, and the first nozzle, at a back end portion thereof, arranged coaxially with the second nozzle and abuts the step portion of the second nozzle in a state having a gap with the large diameter portion of the second nozzle, the first nozzle is connected to the second nozzle by means of a fastener member inserted from a tip end portion of the first nozzle into the gap between the first nozzle and the large diameter portion of the second nozzle, the fastener member having an extension portion screwing with an internal thread groove formed on an inner peripheral surface of the large diameter portion, the back end portion of the first nozzle abuts the step portion of the second nozzle with a tapered interface, the first nozzle has on an outer periphery of the tip end portion thereof a pair of clamped surfaces for being clamped by a tool operable to rotate the first nozzle around a central axis thereof.

In accordance with a fourteenth aspect of the present invention, according to the first aspect of the spray gun may further include a nozzle seizing member inserted from a tip end portion of the coating material nozzle and screwed with the gun main body. The coating material nozzle is mounted to the gun main body being clamped between the nozzle seizing member and the gun main body abutting a back end of the coating material nozzle.

In accordance with a fifteenth aspect of the present invention, according to the first aspect of the spray gun may further include a coating material nozzle inserted to a hole formed in the gun main body in a state of having a gap, a first engaging member to be screwed with an external thread groove formed on an outer periphery of the coating material nozzle, a second engaging member screwed with an internal thread groove formed on an inner periphery of the hole of the gun main body, and a compression spring arranged in a gap formed between the first engaging member and second engaging member. The coating material nozzle is mounted to the gun main body in collaboration with the first engaging member, the second engaging members and the compression spring.

In accordance with a sixteen aspect of the present invention, there is provided a spray gun including: a gun main body; a coating material nozzle attached to a gun barrel part of the gun main body, and formed with a groove at a tip end portion having a coating material ejection opening; and an air cap disposed surrounding the coating material ejection opening of the coating material nozzle, having a side air hole for ejecting air to intersect with coating material ejected from the coating material ejection opening of the coating material nozzle, wherein the groove is formed on a tip end surface of the coating material nozzle in a straight line to pass through the coating material ejection opening, and the coating material nozzle is configured to adjust a position of the groove around a central axis thereof at least at the tip end portion thereof.

Advantageous Effects of Invention

According to the spray gun thus configured, it is possible to adjust the position (in the rotational direction of the coating material nozzle) of the grooves of the tip end portion of the coating material nozzle as desired to acquire a desired spray pattern, even after the coating material nozzle is mounted to the gun main body.

BRIEF DESCRIPTION OF DRAWINGS

FIG. 5 is a configuration diagram of the coating material nozzle mounted to the spray gun according to the first embodiment of the present invention.

FIG. 6 is a configuration diagram of a coating material nozzle mounted to the spray gun according to a second embodiment of the present invention.

FIG. 7 is a configuration diagram of a coating material nozzle mounted to the spray gun according to a third embodiment of the present invention.

FIG. 8 is a configuration diagram of a coating material nozzle mounted to the spray gun according to a fourth embodiment of the present invention.

FIG. 9 is a configuration diagram of a coating material nozzle mounted to the spray gun according to a fifth embodiment of the present invention.

FIG. 10 is a configuration diagram of a coating material nozzle mounted to the spray gun according to a sixth embodiment of the present invention.

FIG. 12 is a configuration diagram of a coating material nozzle mounted to the spray gun according to a ninth embodiment of the present invention.

FIG. 13 is a configuration diagram of a coating material nozzle mounted to the spray gun according to a tenth embodiment of the present invention.

DESCRIPTION OF EMBODIMENTS

Figure 1:
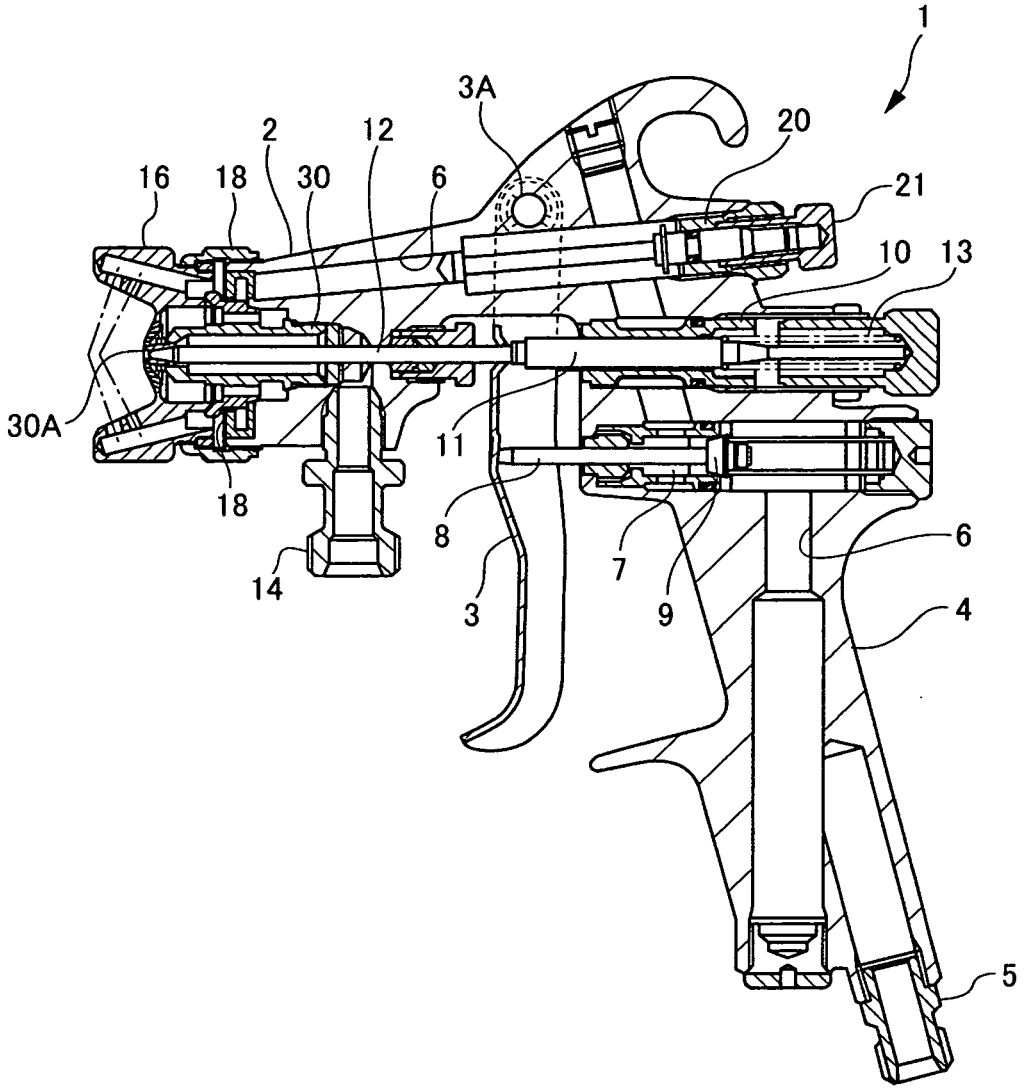
FIG. 1 is an overall configuration diagram of a spray gun according to a first embodiment of the present invention.

In the following, a detailed description will be given of embodiments of the present invention with reference to drawings. In all embodiments of this specification, the same constituent elements have the same reference numerals.

<First Embodiment>

FIG. 1 is an overall configuration diagram of a spray gun according to a first embodiment of the present invention.

In FIG. 1, the spray gun (gun main body) 1 is configured to include a gun barrel part 2, a trigger 3, and a grip part 4. In the description of constituent elements shown in FIG. 1, it should be noted that an end portion on a side of the gun barrel part 2 is sometimes referred to as a "tip end portion", and an end portion on an opposite side to the gun barrel part 2 is sometimes referred to as a "back end portion" for the sake of simplicity.

A compressed air is transmitted from the grip part 4 to an air valve part 7 via an air nipple 5 and an air passage 6, and then the compressed air is transmitted to a tip end portion of the gun barrel part 2.

The trigger 3 is adapted to be pulled toward a side of the grip part 4 centering on a fulcrum 3A, thereby to open an air valve 9 of the air valve part 7 via a valve stem 8 so that the compressed air is transmitted to the tip end portion of the gun barrel part 2.

To the trigger 3 is fixed a needle valve guide 11 that recedes in a guide chamber 10 when the trigger 3 is pulled. To the needle valve guide 11 is fixed a needle valve 12 arranged along a central axis of the gun barrel part 2.

When the trigger 3 is not pulled, a coil spring 13 arranged in the guide chamber 10 is adapted to press the needle valve 12 to a seat inner peripheral surface of a coating material ejection opening 30A of a coating material nozzle 30 that is mounted to the gun barrel part 2 so that the coating material ejection opening 30A is sealed.

When the trigger 3 is pulled, the air valve 9 is configured to be open slightly sooner than the needle valve 12 is pulled away from the coating material ejection opening 30A.

A coating material is supplied to the coating material nozzle 30 from, for example, a coating material reservoir (not shown) or the like that is attached to a coating material joint 14 that is provided on a coating material supply side of the coating material nozzle 30.

Figure 2A:
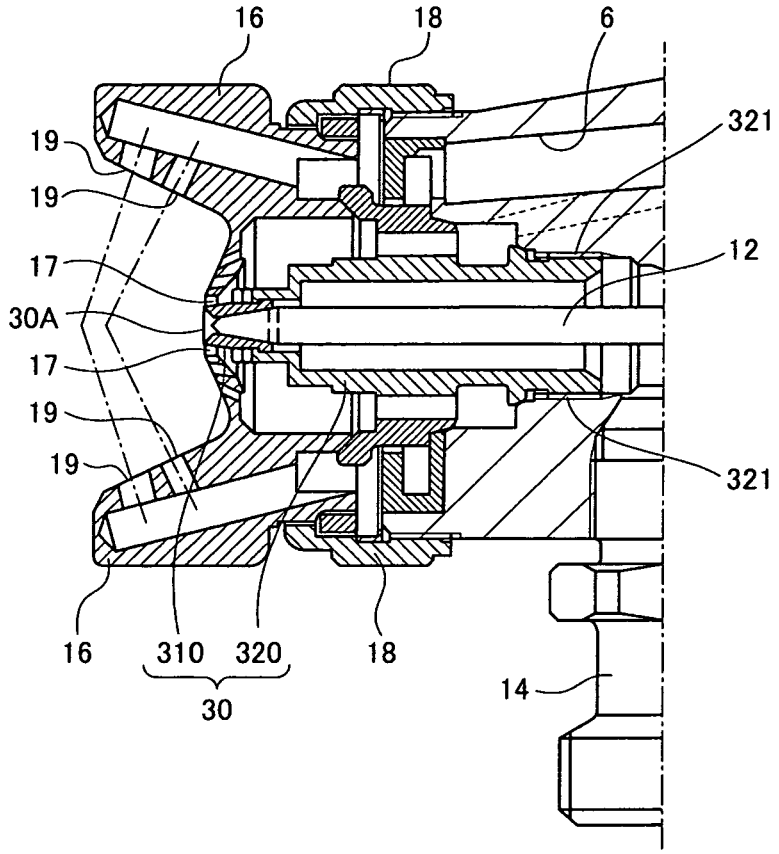
FIG. 2A is an enlarged cross sectional view of a gun barrel part of the spray gun according to the first embodiment of the present invention.

As shown in FIG. 2A, which is an enlarged view of the gun barrel part 2, the coating material nozzle 30 is configured so that a first nozzle 310 at a tip end portion of the coating material nozzle 30 and a second nozzle 320 at a back end portion of the coating material nozzle 30 are coaxially arranged. This means that the coating material nozzle 30 is configured by two discrete objects, the first nozzle 310 and the second nozzle 320, being connected to each other. A detailed description of configuration of the coating material nozzle 30 will be given later.

Figure 3:
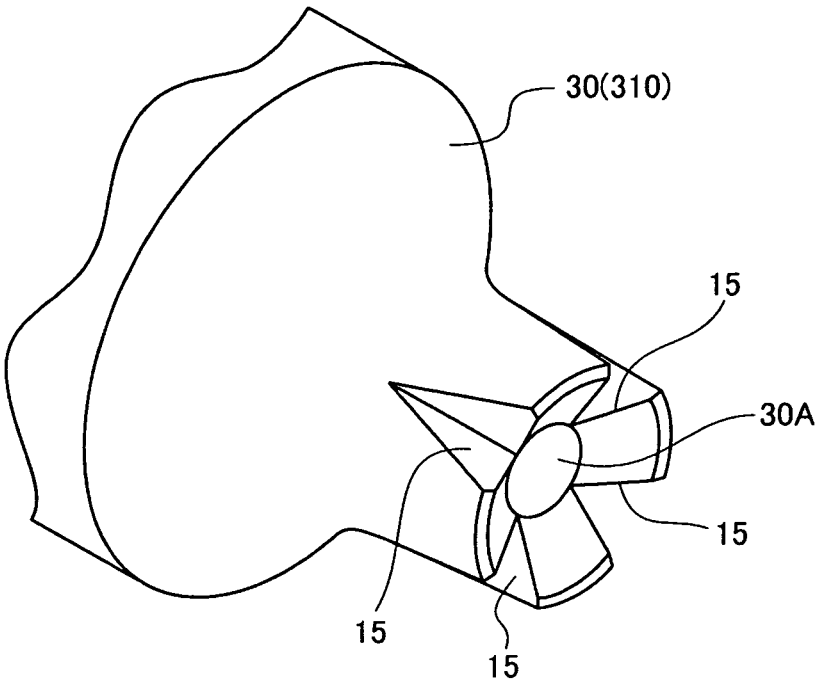
FIG. 3 is a perspective view showing a tip end portion of a coating material nozzle of the spray gun according to the first embodiment of the present invention.

As shown in FIG. 3, at the tip end portion of the coating material nozzle 30 (a tip end portion of the first nozzle 310) is formed with, for example, four grooves 15 equiangularly in a circumferential direction on a periphery of the coating material ejection opening 30A. This means that, viewing from a front side of the coating material ejection opening 30A, the grooves 15 are configured in a crisscross arrangement. The grooves 15 are formed to have, for example, V shaped cross sections and to increase in depth toward the tip end portion of the coating material nozzle 30.

An air cap 16 is arranged to surround the tip end portion of the coating material nozzle 30 (the tip end portion of the first nozzle 310). A ring shaped slit 17 (see FIG. 2) is formed between the air cap 16 and the tip end portion of the coating material nozzle 30 (the tip end portion of the first nozzle 310). The compressed air is ejected from a side of the gun main body 1 to the ring shaped slit 17, on which occasion the compressed air is introduced into each groove 15 of the tip end portion of the first nozzle 310 so as to collide and mix with the coating material ejected from the coating material ejection opening 30A of the coating material nozzle 30 thus expanding gas-liquid contact area. As a result thereof, it is possible for the compressed air, even if being a low pressure air flow, to function to effectively atomize up to a central portion of the ejected coating material.

Figure 4:
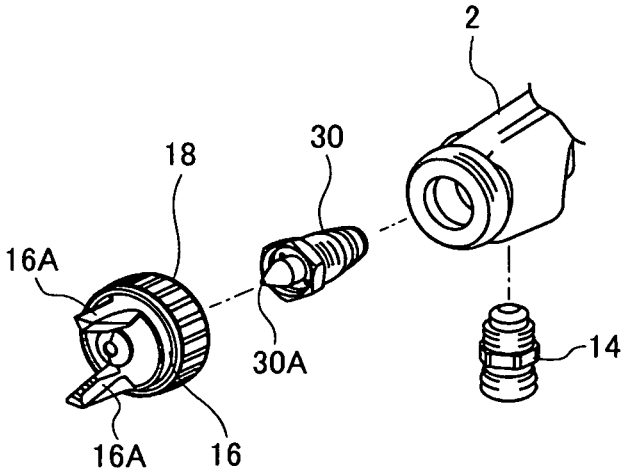
FIG. 4 is an exploded perspective view showing the coating material nozzle, an air cap, and a coating material joint mounted to the gun barrel part of the spray gun according to the first embodiment of the present invention.

The air cap 16 is attached to the gun barrel part 2 by means of an air cap cover 18, and is formed with a pair of horn portions 16A facing toward each other having the coating material ejection opening 30A in between. FIG. 4 is a perspective view showing the coating material nozzle 30, the air cap 16, and the coating material joint 14, which are attached to the gun barrel part 2. FIG. 4 shows that the air cap 16 is formed on a tip end surface thereof with the pair of horn portions 16A protruding forward.

As shown in FIG. 2, each horn portion 16A of the air cap 16 is formed with side air holes 19 connected to the air passage 6. The side air holes 19 are adapted to eject the compressed air so that the compressed air intersects with the coating material ejected from the coating material ejection opening 30A of the coating material nozzle 30. As a result thereof, the coating material ejected from the coating material nozzle 30 can form an elliptical spray pattern by the aid of the compressed air ejected from the side air holes 19 of the air cap 16. The compressed air transmitted to the side air holes 19 of the air cap 16 is adjusted in flow rate by means of a spread pattern adjustment device 20 (see FIG. 1) and then ejected from the side air holes 19. In the spread pattern adjustment device 20, a pattern adjustment tab 21 is adapted to be rotated so that the compressed air is adjusted in flow rate. As a result thereof, the spray pattern of the coating material ejected from the coating material nozzle 30 is adjusted in spread angle in a fan shape.

Figure 5A:
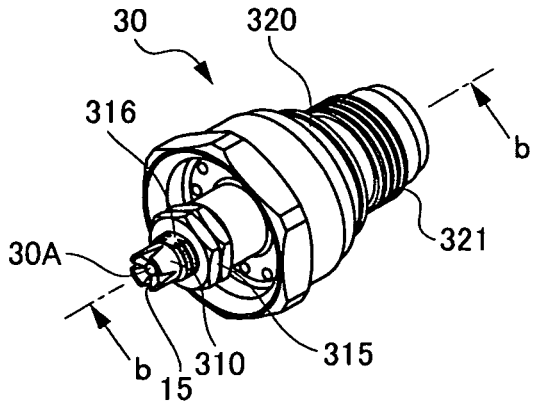
FIG. 5A is a perspective view of the coating material nozzle.
Figure 5B:
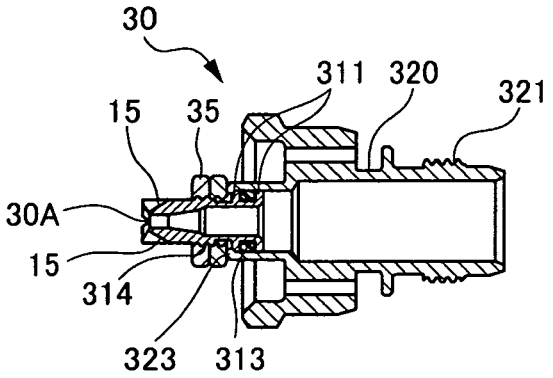
FIG. 5B is a cross sectional view along b-b line shown in FIG. 5A.
Figure 5C:
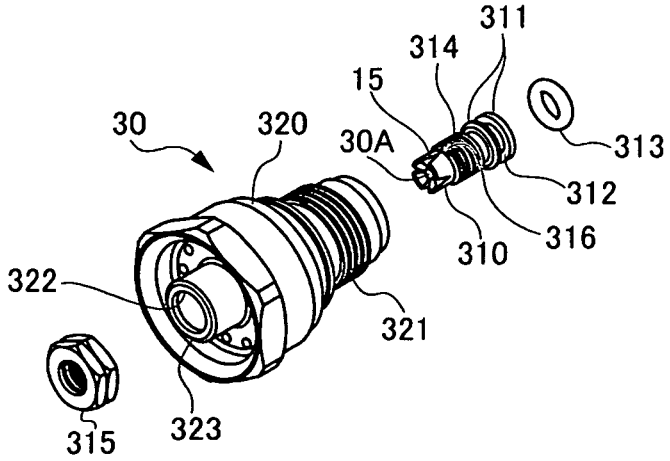
FIG. 5C is an exploded perspective view of the coating material nozzle into the first nozzle and the second nozzle.

FIG. 5A is a perspective view of the coating material nozzle 30, and FIG. 5B is a cross sectional view along b-b line shown in FIG. 5A. FIG. 5C is an exploded perspective view of the coating material nozzle 30 into the first nozzle 310 and the second nozzle 320.

The coating material nozzle 30 shown in FIGS. 5A to 5C is configured by the first nozzle 310 and the second nozzle 320 coaxially arranged, as described above. The first nozzle 310 is configured as the tip end portion of the coating material nozzle 30, and the second nozzle 320 is configured as the back end portion of the coating material nozzle 30.

The second nozzle 320 is in a cylindrical shape relatively large in inner diameter and formed with a thread groove 321 on an outer periphery of a back end portion thereof. The second nozzle 320 is fixed to the gun barrel part 2 in a manner that the second nozzle 320 is inserted into a hole of the gun barrel part 2 and rotated around the central axis thereof so that the thread groove 321 of the second nozzle 320 is screwed with an internal thread groove (not shown) formed on an inner peripheral surface of the hole.

The second nozzle 320 is formed with an edge wall portion 323 (see FIG. 5C) having an opening 322 at an open end of a tip end portion of the second nozzle 320. The tip end portion of the first nozzle 310 is adapted to be inserted from an open end of the back end portion of the second nozzle 320 so as to protrude through the opening 322 of the second nozzle 320.

The first nozzle 310 is in a cylindrical shape having an outer diameter approximately identical to a diameter of the opening 322 of the second nozzle 320, and is formed with a large diameter portion 311 large in outer diameter at a back end portion thereof. As a result thereof, when the first nozzle 310 is inserted from the open end of the back end portion of the second nozzle 320, the large diameter portion 311 is engaged by the edge wall portion 323 of the second nozzle 320, and the tip end portion of the first nozzle 310 protrudes from the opening 322.

The large diameter portion 311 of the first nozzle 310 is formed with a ring groove 312 (see FIG. 5C) on a circumferential side surface along a circumferential direction. An O-ring 313 fits in the ring groove 312. The O-ring 313 is adapted to seal a gap between the second nozzle 320 and the first nozzle 310.

The first nozzle 310 thus protruding from the opening 322 of the second nozzle 320 is formed with a thread groove 314 (see FIG. 5C) on a circumferential side surface adjacent to the edge wall portion 323 of the second nozzle 320. The thread groove 314 is adapted to be screwed with a fastener member 315 such as jam nuts inserted from the tip end portion of the first nozzle 310.

As a result thereof, the first nozzle 310 is connected to the second nozzle 320 in a manner that the edge wall portion 323 of the second nozzle 320 is clamped between the fastener member 315 and the large diameter portion 311.

As shown in FIG. 3, the first nozzle 310 is formed at the tip end portion thereof with the four grooves 15 equiangularly in the circumferential direction on the periphery of the coating material ejection opening 30A. Furthermore, a pair of clamped surfaces 316 are formed on a circumferential side surface behind the grooves 15 of the tip end portion of the first nozzle 310. The clamped surfaces 316 are adapted to be clamped by, for example, a wrench or the like so that the first nozzle 310 may be rotated around a central axis thereof.

Figure 2B:
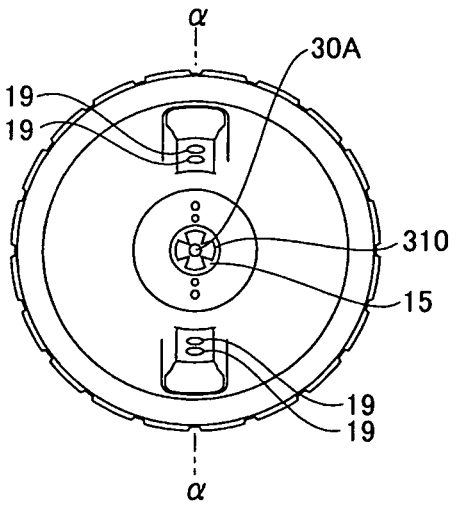
FIGS. 2B and 2C are front views showing a tip end of the gun barrel part of the spray gun according to the first embodiment of the present invention.
Figure 2C:
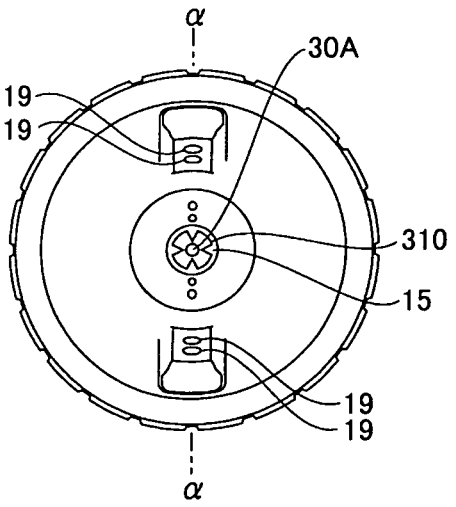

The coating material nozzle 30 thus configured is to be mounted to the gun barrel part 2 as follows. First, the first nozzle 310 is inserted from the back end portion of the second nozzle 320 so that the tip end portion of the first nozzle 310 protrudes from the opening 322 of the second nozzle 320. Then, the fastener member 315 is inserted from the tip end portion of the first nozzle 310 and screwed with the thread groove 314 so that the edge wall portion 323 of the second nozzle 320 is clamped between the fastener member 315 and the large diameter portion 311 of the first nozzle 310. As a result thereof, the first nozzle 310 and the second nozzle 320 are connected. Subsequently, the second nozzle 320 is inserted into the hole of the gun barrel part 2 and rotated around the central axis thereof. As a result thereof, the second nozzle 320 is fixed to the gun barrel part 2 in a manner that the thread groove 321 of the second nozzle 320 is screwed with the internal thread groove (not shown) formed on the inner peripheral surface of the hole of the gun barrel part 2. Then, the first nozzle 310 is rotated around the central axis thereof by clamping the pair of clamped surfaces 316 formed at the tip end portion of the first nozzle 310 using, for example, a wrench or the like. Thus, the grooves 15 of the tip end portion of the first nozzle 310 are adjusted so as to be positioned to a proper position with respect to the side air holes 19 of the air cap 16, for example, as shown in FIGS. 2B and 2C. FIGS. 2B and 2C show examples of cases in which the grooves 15 of the tip end portion of the first nozzle 310 are adjusted to proper positions with respect to the side air holes 19 of the air cap 16.

FIG. 2B and FIG. 2C both show cases in which the grooves 15 are adjusted to proper positions with respect to the side air holes 19 of the air cap 16. More particularly, FIG. 2B shows a case in which a side where the grooves 15 are not formed of the tip end portion of the first nozzle 310 is adjusted to be positioned on a line (shown with a symbol a in FIG. 2B) between the side air holes 19 of the air cap 16 arranged having the first nozzle 310 in between. While, FIG. 2C shows a case in which a side having the grooves 15 formed of the tip end portion of the first nozzle 310 is adjusted to be positioned on a line (shown with a symbol $\alpha$ in FIG. 2C) between the side air holes 19 of the air cap 16 arranged having the first nozzle 310 in between.

It should be noted that an angular position adjustment (in a rotational direction of the first nozzle 310) of the grooves 15 of the tip end portion of the first nozzle 310 is not limited to the cases shown in FIGS. 2B and 2C. It is because a desired spray pattern may be acquired by a different adjustment from those shown in FIGS. 2B and 2C. By way of the angular position adjustment (in the rotational direction of the first nozzle 310) of the grooves 15 of the tip end portion of the first nozzle 310, the spray pattern can be arbitrarily changed in thickness distribution from flat to center thick or center thick to flat. Therefore, an appropriate spray pattern according to a coated matter can be acquired by selecting an appropriate distribution.

As above, in the first embodiment, a coating material nozzle has a first nozzle and a second nozzle coaxially arranged, the second nozzle being a part screwed to a gun main body, and the first nozzle being a part including a coating material ejection opening formed with grooves on a periphery thereof and being connected to the second nozzle to adjust an angular position of the grooves around a central axis thereof.

In the coating material nozzle of the spray gun thus configured, even after the second nozzle thereof is fixed to the gun main body, the angular position of the grooves of the first nozzle around the central axis thereof can be adjusted with respect to the second nozzle.

<Second Embodiment>

FIG. 6 is a configuration diagram of a coating material nozzle 40 mounted to a spray gun 1 according to a second embodiment of the present invention.

Figure 6A:
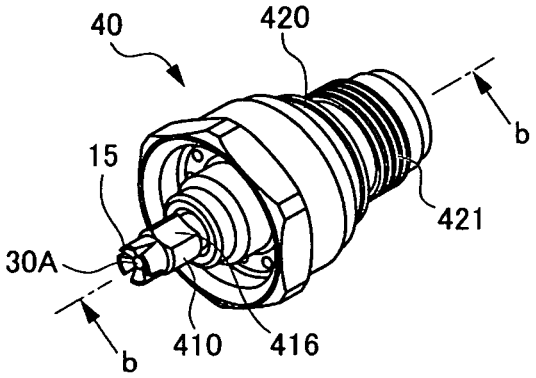
FIG. 6A is a perspective view of the coating material nozzle.
Figure 6B:
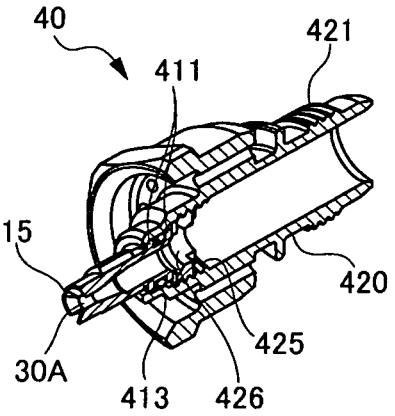
FIG. 6B is a cross sectional view along b-b line shown in FIG. 6A.
Figure 6C:
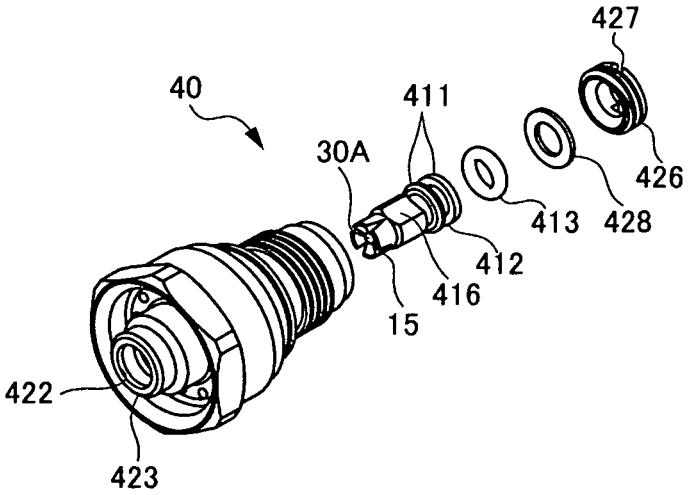
FIG. 6C is an exploded perspective view of the coating material nozzle into a first nozzle and a second nozzle.

FIG. 6A is a perspective view of the coating material nozzle 40, and FIG. 6B is a cross sectional view along b-b line shown in FIG. 6A. FIG. 6C is an exploded perspective view of the coating material nozzle 40 into a first nozzle 410 and a second nozzle 420.

The coating material nozzle 40 shown in FIGS. 6A to 6C is configured by the first nozzle 410 and the second nozzle 420 coaxially arranged, as described above. The first nozzle 410 is configured as a tip end portion of the coating material nozzle 40, and the second nozzle 420 is configured as a back end portion of the coating material nozzle 40.

The second nozzle 420 is in a cylindrical shape relatively large in inner diameter and formed with a thread groove 421 on an outer periphery of a back end portion thereof. The second nozzle 420 is fixed to a gun barrel part 2 in a manner that the second nozzle 420 is inserted into a hole of the gun barrel part 2 and rotated around a central axis thereof so that the thread groove 421 of the second nozzle 420 is screwed with an internal thread groove (not shown) formed on an inner peripheral surface of the hole.

The second nozzle 420 is formed with an engaging portion 423 (see FIG. 6C) on a periphery of an opening 422 of a tip end portion thereof. The opening 422 of the second nozzle 420 is adapted to protrude therethrough a tip end portion of the first nozzle 410 inserted from an open end of the back end portion of the second nozzle 420.

The first nozzle 410 is in a cylindrical shape whose outer diameter is approximately identical to a diameter of the opening 422 of the second nozzle 420, and is formed with a large diameter portion 411 large in outer diameter at a back end portion thereof. As a result thereof, when the first nozzle 410 is inserted from the open end of the back end portion of the second nozzle 420, the large diameter portion 411 is engaged by the engaging portion 423 of the second nozzle 420, and the tip end portion of the first nozzle 410 protrudes from the opening 422.

The large diameter portion 411 of the first nozzle 410 is formed with a ring groove 412 (see FIG. 6C) on a circumferential side surface along a circumferential direction. An O-ring 413 fits in the ring groove 412. The O-ring 413 is adapted to seal a gap between the second nozzle 420 and the first nozzle 410.

An inner peripheral surface of the second nozzle 420 is formed with an internal thread groove 425 (see FIG. 6B) at an adjacent part to the large diameter portion 411 of the first nozzle 410 when the first nozzle 410 is inserted from the back end portion of the second nozzle 420 so that the tip end portion of the first nozzle 410 protrudes from the opening 422 of the second nozzle 420. The internal thread groove 425 is adapted to be screwed with a ring shaped member 426 that is formed with a thread groove on an outer periphery to press the large diameter portion 411 of the first nozzle 410 to the engaging portion 423. In order to thread the ring shaped member 426 with the internal thread groove 425 inside the second nozzle 420, the ring shaped member 426 is formed with a screw driver groove 427 extending in a diameter direction on a surface on a side of the back end portion of the second nozzle 420.

A slip ring 428 formed by fluororesin or the like is adapted to intervene between the ring shaped member 426 and the large diameter portion 411 of the first nozzle 410 so as to enable a relatively smooth rotation of the ring shaped member 426 of the first nozzle 410 around a central axis thereof.

As shown in FIG. 3, the first nozzle 410 is formed at the tip end portion thereof with four grooves 15 equiangularly in a circumferential direction on a periphery of the coating material ejection opening 30A. Furthermore, a pair of clamped surfaces 416 are formed on a circumferential side surface behind the grooves 15 of the tip end portion of the first nozzle 410. The clamped surfaces 416 are adapted to be clamped by, for example, a wrench or the like so that the first nozzle 410 may be rotated around the central axis thereof.

The coating material nozzle 40 thus configured is to be mounted to the gun barrel part 2 as follows. First, the first nozzle 410 attached by the 0-ring 413 is inserted from the back end portion of the second nozzle 420 so that the tip end portion of the first nozzle 410 protrudes from the opening 422 of the second nozzle 420. Then, the slip ring 428 is inserted, and the ring shaped member 426 is screwed with the internal thread groove 425 by inserting a tip of a screw driver in the screw driver groove 427 of the ring shaped member 426. As a result thereof, the first nozzle 410 and the second nozzle 420 are connected. Subsequently, the second nozzle 420 is inserted into the hole of the gun barrel part 2 and rotated around the central axis thereof. As a result thereof, the second nozzle 420 is fixed to the gun barrel part 2 in a manner that the thread groove 421 of the second nozzle 420 is screwed with the internal thread groove (not shown) formed on the inner peripheral surface of the hole of the gun barrel part 2. Then, the first nozzle 410 is rotated around the central axis thereof by clamping the pair of clamped surfaces 416 formed at the tip end portion of the first nozzle 410 using, for example, a wrench or the like. Thus, the grooves 15 of the tip end portion of the first nozzle 410 are adjusted so as to be positioned to a proper position with respect to side air holes 19 of an air cap 16, for example, as shown in FIGS. 2B and 2C.

<Third Embodiment>

FIG. 7 is a configuration diagram of a coating material nozzle 50 mounted to a spray gun 1 according to a third embodiment of the present invention.

Figure 7A:
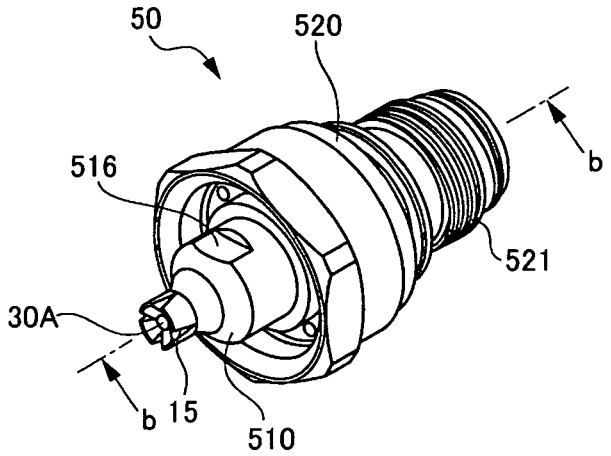
FIG. 7A is a perspective view of the coating material nozzle.
Figure 7B:
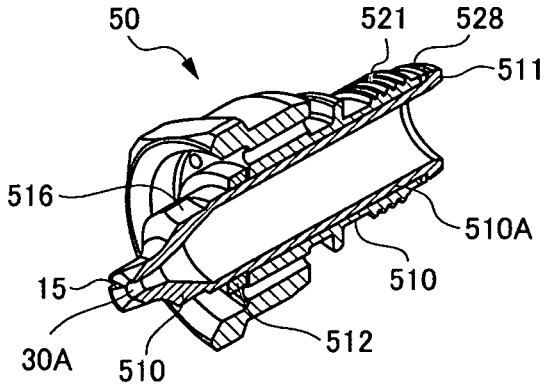
FIG. 7B is a cross sectional view along b-b line shown in FIG. 7A.
Figure 7C:
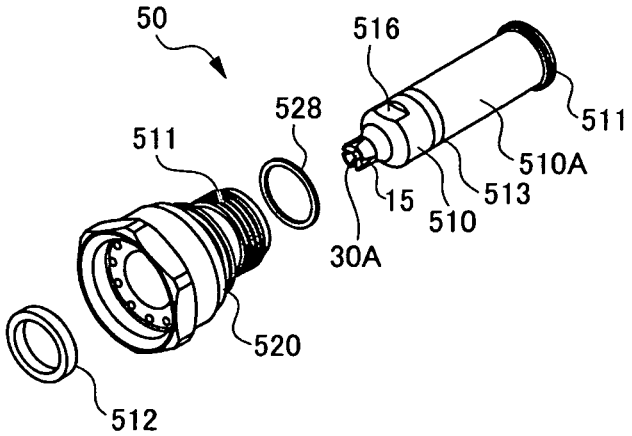
FIG. 7C is an exploded perspective view of the coating material nozzle into a first nozzle and a second nozzle.

FIG. 7A is a perspective view of the coating material nozzle 50, and FIG. 7B is a cross sectional view along b-b line shown in FIG. 7A. FIG. 7C is an exploded perspective view of the coating material nozzle 50 into a first nozzle 510 and a second nozzle 520.

The coating material nozzle 50 shown in FIGS. 7A to 7C is configured by the first nozzle 510 and the second nozzle 520 coaxially arranged, as described above. The first nozzle 510 is configured as a tip end portion of the coating material nozzle 50, and the second nozzle 520 is configured as a back end portion of the coating material nozzle 50.

The second nozzle 520 is in a cylindrical shape relatively large in inner diameter and formed with a thread groove 521 on an outer periphery of a back end portion thereof. The second nozzle 520 is fixed to a gun barrel part 2 in a manner that the second nozzle 520 is inserted into a hole of the gun barrel part 2 and rotated around a central axis thereof so that the thread groove 521 of the second nozzle 520 is screwed with an internal thread groove (not shown) formed on an inner peripheral surface of the hole.

The first nozzle 510 is formed with an extension portion 510A that extends from a back end portion of the first nozzle 510 along an inner peripheral surface of the second nozzle 520 in longitudinal direction, and a large diameter portion 511 large in outer diameter at a back end portion of the extension portion 510A. Here, an inner diameter of the second nozzle 520 along axial direction is configured to be slightly larger than an outer diameter of the extension portion 510A and a tip end portion of the first nozzle 510 along the axial direction. As a result thereof, when the first nozzle 510 is inserted from an open end of the back end portion of the second nozzle 520, the large diameter portion 511 of the first nozzle 510 is engaged by the back end portion of the second nozzle 520, and the tip end portion of the first nozzle 510 protrudes from a tip end portion of the second nozzle 520. Here, a slip ring 528 is arranged around the extension portion 510A and between the back end portion of the second nozzle 520 and the large diameter portion 511 of the first nozzle 510. The slip ring 528 is adapted to enable a relatively smooth rotation of the first nozzle 510 with regard to the second nozzle 520 around a central axis thereof.

Furthermore, a stopper ring 512 fits in a ring groove 513 of the first nozzle 510 from a side of the tip end portion of the first nozzle 510, which has been inserted into the second nozzle 520. The stopper ring 512 is adapted to prevent disconnection of the first nozzle 510 from the second nozzle 520.

As shown in FIG. 3, the first nozzle 510 is formed at the tip end portion thereof with four grooves 15 equiangularly in circumferential direction on a periphery of a coating material ejection opening 30A. Furthermore, a pair of clamped surfaces 516 are formed on a circumferential side surface behind the grooves 15 of the tip end portion of the first nozzle 510. The clamped surfaces 516 are adapted to be clamped by, for example, a wrench or the like so that the first nozzle 510 may be rotated around the central axis thereof.

The coating material nozzle 50 thus configured is to be mounted to the gun barrel part 2 as follows. First, the tip end portion of the first nozzle 510 is inserted from the back end portion of the second nozzle 520 so that the tip end portion of the first nozzle 510 protrudes from an opening of the tip end portion of the second nozzle 520. Here, the slip ring 528 is clamped between the second nozzle 520 and the large diameter portion 511 of the first nozzle 510. Then, the stopper ring 512 is inserted from the tip end portion of the first nozzle 510 to fit in the ring groove 513 of the first nozzle 510. Subsequently, the second nozzle 520 is inserted in the hole of the gun barrel part 2 and rotated around the central axis thereof. As a result thereof, the second nozzle 520 is fixed to the gun barrel part 2 in a manner that the thread groove 521 of the second nozzle 520 is screwed with the internal thread groove (not shown) formed on the inner peripheral surface of the hole of the gun barrel part 2. Then, the first nozzle 510 is rotated around the central axis thereof by clamping the pair of clamped surfaces 516 formed at the tip end portion of the first nozzle 510 using, for example, a wrench or the like. Thus, the grooves 15 of the tip end portion of the first nozzle 510 are adjusted so as to be positioned to a proper position with respect to side air holes 19 of an air cap 16, for example, as shown in FIGS. 2B and 2C.

<Fourth Embodiment>

FIG. 8 is a configuration diagram of a coating material nozzle 60 mounted to a spray gun 1 according to a fourth embodiment of the present invention.

Figure 8A:
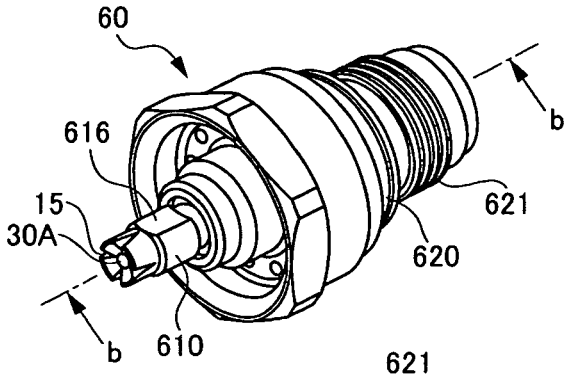
FIG. 8A is a perspective view of the coating material nozzle.
Figure 8B:
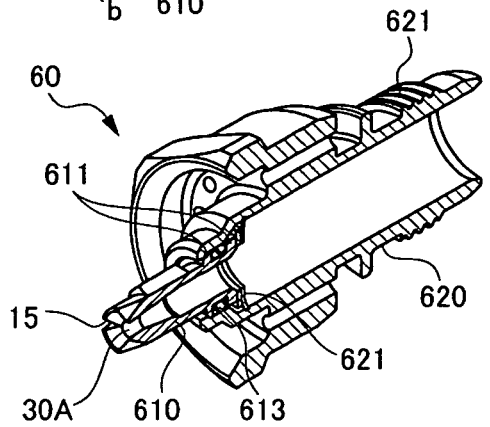
FIG. 8B is a cross sectional view from a tip end portion of the coating material nozzle along b-b line shown in FIG. 8A.
Figure 8C:
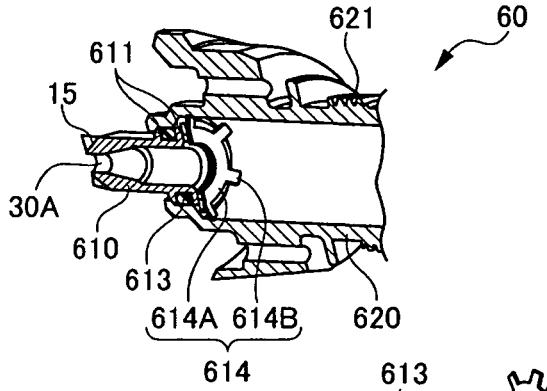
FIG. 8C is a cross sectional view from a back end portion of the coating material nozzle along b-b line shown in FIG. 8A.
Figure 8D:
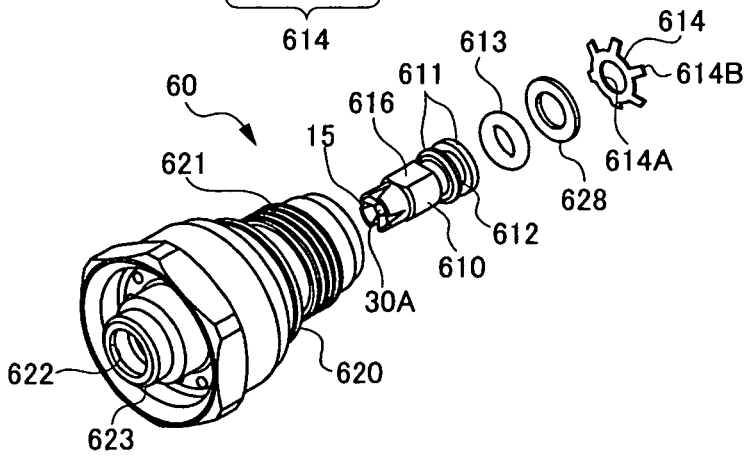
FIG. 8D is an exploded perspective view of the coating material nozzle into a first nozzle and a second nozzle.

FIG. 8A is a perspective view of the coating material nozzle 60, FIG. 8B is a cross sectional view from a tip end portion of the coating material nozzle 60 along b-b line shown in FIG. 8A, and FIG. 8C is a cross sectional view from a back end portion of the coating material nozzle 60 along b-b line shown in FIG. 8A. FIG. 8D is an exploded perspective view of the coating material nozzle 60 into a first nozzle 610 and a second nozzle 620.

The coating material nozzle 60 shown in FIGS. 8A to 8D is configured by the first nozzle 610 and the second nozzle 620 coaxially arranged, as described above. The first nozzle 610 is configured as the tip end portion of the coating material nozzle 60, and the second nozzle 620 is configured as the back end portion of the coating material nozzle 60.

The second nozzle 620 is in a cylindrical shape relatively large in inner diameter and formed with a thread groove 621 on an outer periphery of a back end portion thereof. The second nozzle 620 is fixed to a gun barrel part 2 in a manner that the second nozzle 620 is inserted into a hole of the gun barrel part 2 and rotated around a central axis thereof so that the thread groove 621 of the second nozzle 620 is screwed with an internal thread groove (not shown) formed on an inner peripheral surface of the hole.

The second nozzle 620 is formed with an engaging portion 623 (see FIG. 8D) on a periphery of an opening 622 of a tip end portion thereof. The opening 622 of the second nozzle 620 is adapted to protrude therethrough a tip end portion of the first nozzle 610 inserted from an open end of the back end portion of the second nozzle 620.

The first nozzle 610 is in a cylindrical shape whose outer diameter is approximately identical to a diameter of the opening 622 of the second nozzle 620, and is formed with a large diameter portion 611 large in outer diameter at a back end portion thereof. As a result thereof, when the first nozzle 610 is inserted from the open end of the back end portion of the second nozzle 620, the large diameter portion 611 is engaged by the engaging portion 623 of the second nozzle 620, and the tip end portion of the first nozzle 610 protrudes from the opening 622.

The large diameter portion 611 of the first nozzle 610 is formed with a ring groove 612 (see FIG. 8D) on a circumferential side surface along circumferential direction. An O-ring 613 fits in the ring groove 612. The O-ring 613 is adapted to seal a gap between the second nozzle 620 and the first nozzle 610.

Following the first nozzle 610 being inserted in the second nozzle 620, as described above, a push washer 614 is inserted from the open end of the back end portion of the second nozzle 620. The push washer 614 is an elastic body configured such that, for example, six teeth 614B protrudes outward from a ring material 614A equiangularly in circumferential direction. When the push washer 614 thus configured is inserted in the second nozzle 620, having tips of the teeth 614B abutted to an inner peripheral surface of the second nozzle 620, the ring material 614A is placed ahead of the teeth 614B. As a result thereof, the tips of the teeth 614B are engaged by the inner peripheral surface of the second nozzle 620 against a force applied to the ring material 614A from opposite direction to insertion direction so that the first nozzle 610 may be prevented from moving toward the push washer 614. Thus, the push washer 614 is adapted to be inserted in the second nozzle 620 to press the large diameter portion 611 to the engaging portion 623 of the second nozzle 620.

A slip ring 628 formed by fluororesin or the like is adapted to intervene between the push washer 614 and the large diameter portion 611 of the first nozzle 610 so as to enable a relatively smooth rotation of the first nozzle 610 with regard to the push washer 614 around a central axis thereof.

As shown in FIG. 3, the first nozzle 610 is formed at the tip end portion thereof with, for example, four grooves 15 equiangularly in circumferential direction on a periphery of the coating material ejection opening 30A. Furthermore, a pair of clamped surfaces 616 are formed parallel to each other on a circumferential side surface of the tip end portion of the first nozzle 610. The clamped surfaces 616 are adapted to be clamped by, for example, a wrench or the like so that the first nozzle 610 may be rotated around the central axis thereof.

The coating material nozzle 60 thus configured is to be mounted to the gun barrel part 2 as follows. First, the first nozzle 610 is inserted from the back end portion of the second nozzle 620 so that the tip end portion of the first nozzle 610 protrudes from the opening 622 of the second nozzle 620. Then, the slip ring 628 and the push washer 614 are inserted. As a result thereof, the first nozzle 610 and the second nozzle 620 are connected. Subsequently, the second nozzle 620 is inserted in the hole of the gun barrel part 2 and rotated around the central axis thereof. As a result thereof, the second nozzle 620 is fixed to the gun barrel part 2 in a manner that the thread groove 621 of the second nozzle 620 is screwed with the internal thread groove (not shown) formed on the inner peripheral surface of the hole of the gun barrel part 2. Then, the first nozzle 610 is rotated around the central axis thereof by clamping the pair of clamped surfaces 616 formed at the tip end portion of the first nozzle 610 using, for example, a wrench or the like. Thus, the grooves 15 of the tip end portion of the first nozzle 610 are adjusted so as to be positioned to a proper position with respect to side air holes 19 of an air cap 16, for example, as shown in FIGS. 2B and 2C.

<Fifth Embodiment>

FIG. 9 is a configuration diagram of a coating material nozzle 60' mounted to a spray gun 1 according to a fifth embodiment of the present invention.

Figure 9A:
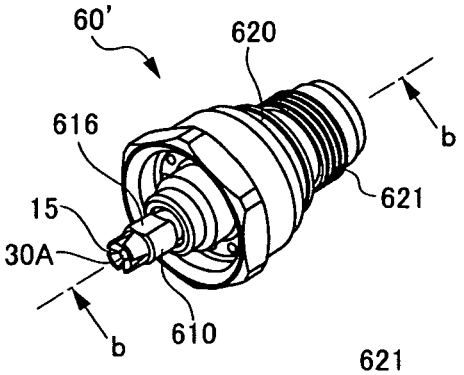
FIG. 9A is a perspective view of the coating material nozzle.
Figure 9B:
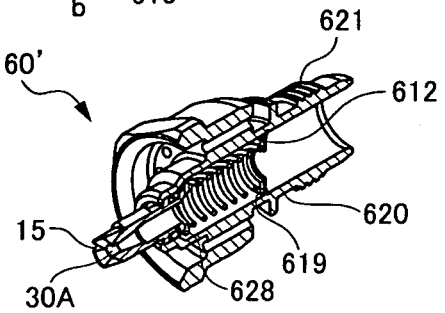
FIG. 9B is a cross sectional view from a tip end portion of the coating material nozzle along b-b line shown in FIG. 9A.
Figure 9C:
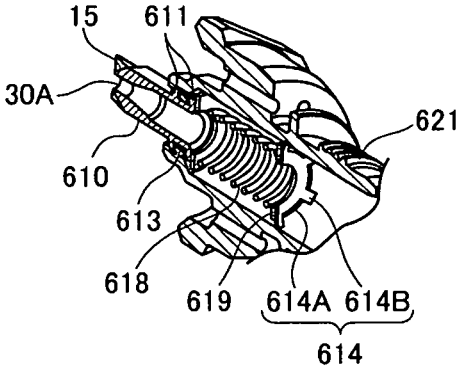
FIG. 9C is a cross sectional view from a back end portion of the coating material nozzle along b-b line shown in FIG. 9A.
Figure 9D:
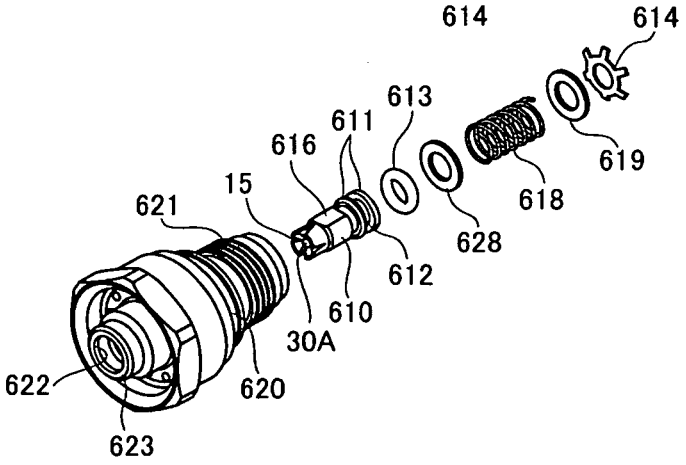
FIG. 9D is an exploded perspective view of the coating material nozzle into a first nozzle and a second nozzle.

FIG. 9A is a perspective view of the coating material nozzle 60', FIG. 9B is a cross sectional view from a tip end portion of the coating material nozzle 60' along b-b line shown in FIG. 9A, and FIG. 9C is a cross sectional view from a back end portion of the coating material nozzle 60' along b-b line shown in FIG. 9A. FIG. 9D is an exploded perspective view of the coating material nozzle 60' into a first nozzle 610 and a second nozzle 620.

Since the coating material nozzle 60' shown in FIG. 9 is configured remarkably similar to the coating material nozzle 60 shown in FIG. 8, the following description is directed to only points of difference therebetween. Therefore, the same constituent elements as those of the coating material nozzle 60 of FIG. 8 are denoted by the same symbols as FIG. 8.

Compared to the coating material nozzle 60 shown in FIG. 8, the coating material nozzle 60' shown in FIG. 9 is configured to have a spring 618 in a shape of coil and a slip ring 619 newly added. In addition to the configuration shown in FIG. 8, the spring 618 and the slip ring 619 are adapted to intervene between the slip ring 628 and the push washer 614. As a result thereof, a tip end portion of the first nozzle 610 is pressed to the second nozzle 620 due to a bias force from the spring 618. Thus, it is possible to more reliably connect the first nozzle 610 to the second nozzle 620.

<Sixth Embodiment>

FIG. 10 is a configuration diagram of a coating material nozzle 70 mounted to a spray gun 1 according to a sixth embodiment of the present invention.

Figure 10A:
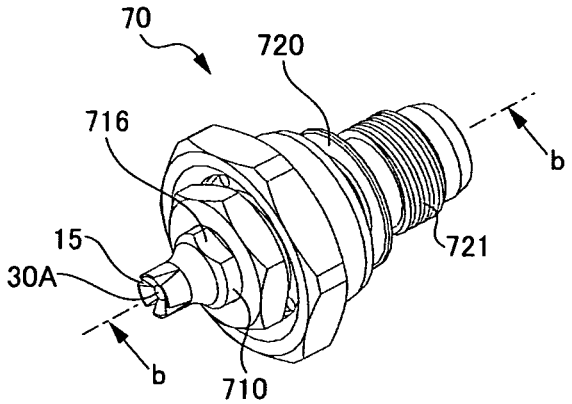
FIG. 10A is a perspective view of the coating material nozzle.
Figure 10B:
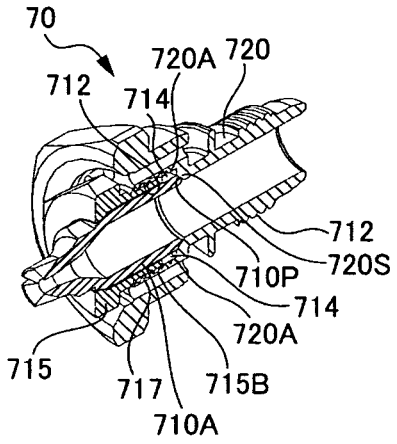
FIG. 10B is a cross sectional view along b-b line shown in FIG. 10A.
Figure 10C:
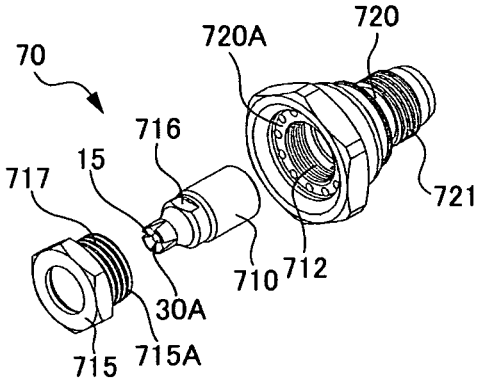
FIG. 10C is an exploded perspective view of the coating material nozzle into a first nozzle and a second nozzle.

FIG. 10A is a perspective view of the coating material nozzle 70, and FIG. 10B is a cross sectional view along b-b line shown in FIG. 10A. FIG. 10C is an exploded perspective view of the coating material nozzle 70 into a first nozzle 710 and a second nozzle 720.

The coating material nozzle 70 shown in FIGS. 10A to 10C is configured by the first nozzle 710 and the second nozzle 720 coaxially arranged, as described above. The first nozzle 710 is configured as a tip end portion of the coating material nozzle 70, and the second nozzle 720 is configured as a back end portion of the coating material nozzle 70.

The second nozzle 720 is in a cylindrical shape relatively large in inner diameter and formed with a thread groove 721 on an outer periphery of a back end portion thereof. The second nozzle 720 is fixed to a gun barrel part 2 in a manner that the second nozzle 720 is inserted into a hole of the gun barrel part 2 and rotated around a central axis thereof so that the thread groove 721 of the second nozzle 720 is screwed with an internal thread groove (not shown) formed on an inner peripheral surface of the hole.

The second nozzle 720 is formed at a tip end portion thereof with a large diameter portion 720A large in inner diameter. The large diameter portion 720A is formed on an inner peripheral surface thereof with an internal thread groove 712 to be threaded with an extension portion 715A that coaxially extends from a nut 715, which will be described later.

In the first nozzle 710, a back end portion 710A thereof is arranged inside the large diameter portion 720A of the second nozzle 720, and an open end 710P of the back end portion 710A abuts a step portion 720S delimiting the large diameter portion 720A of the second nozzle 720. Here, an interface between the back end portion 710A of the first nozzle 710 and the step portion 720S of the second nozzle 720 is configured to be a tapered interface. As a result thereof, it is possible to enhance sealability between the first nozzle 710 and the second nozzle 720. The back end portion 710A of the first nozzle 710 is formed approximately identical in inner diameter and outer diameter to the second nozzle 720 excluding the large diameter portion 720A. When the first nozzle 710 and the second nozzle 720 are coaxially arranged, a gap 714 is formed between an outer periphery of the back end portion 710A of the first nozzle 710 and the inner peripheral surface of the large diameter portion 720A of the second nozzle 720.

The nut 715 is adapted to be inserted headed by the extension portion 715A in the large diameter portion 720A of the second nozzle 720 from a tip end portion of the first nozzle 710 and to be rotated so that a thread groove 717 formed on an outer periphery of the extension portion 715A is screwed with the internal thread groove 712 of the large diameter portion 720A of the second nozzle 720. As a result thereof, the nut 715 is restricted from moving in axial direction with regard to the first nozzle 710, the first nozzle 710 is pressed to the second nozzle 720 in the axial direction, and the first nozzle 710 is connected to the nozzle 720.

As shown in FIG. 3, the first nozzle 710 is formed at the tip end portion thereof with four grooves 15 equiangularly in circumferential direction on a periphery of a coating material ejection opening 30A. Furthermore, a pair of clamped surfaces 716 are formed parallel to each other on a circumferential side surface of the tip end portion of the first nozzle 710. The clamped surfaces 716 are adapted to be clamped by, for example, a wrench or the like so that the first nozzle 710 may be rotated around the central axis thereof.

The coating material nozzle 70 thus configured is to be mounted to the gun barrel part 2 as follows. First, the first nozzle 710 is inserted in the large diameter portion 720A of the second nozzle 720, and the nut 715 is inserted from the tip end portion of the first nozzle 710. Then, the nut 715 is rotated so that the thread groove 717 of the extension portion 715A is screwed with the large diameter portion 720A of the second nozzle 720. As a result thereof, the nut 715 is restricted from moving with regard to the first nozzle 710, the first nozzle 710 is pressed to the second nozzle 720 in the axial direction, and the first nozzle 710 is connected to the nozzle 720. Subsequently, the second nozzle 720 is inserted in the hole of the gun barrel part 2 and rotated around the central axis thereof. As a result thereof, the second nozzle 720 is fixed to the gun barrel part 2 in a manner that the thread groove 721 of the second nozzle 720 is screwed with the internal thread groove (not shown) formed on the inner peripheral surface of the hole of the gun barrel part 2. Then, the first nozzle 710 is rotated around a central axis thereof by clamping the pair of clamped surfaces 716 formed at the tip end portion of the first nozzle 710 using, for example, a wrench or the like. Thus, the grooves 15 of the tip end portion of the first nozzle 710 are adjusted so as to be positioned to a proper position with respect to side air holes 19 of an air cap 16, for example, as shown in FIGS. 2B and 2C.

<Seventh Embodiment>

Figure 11:
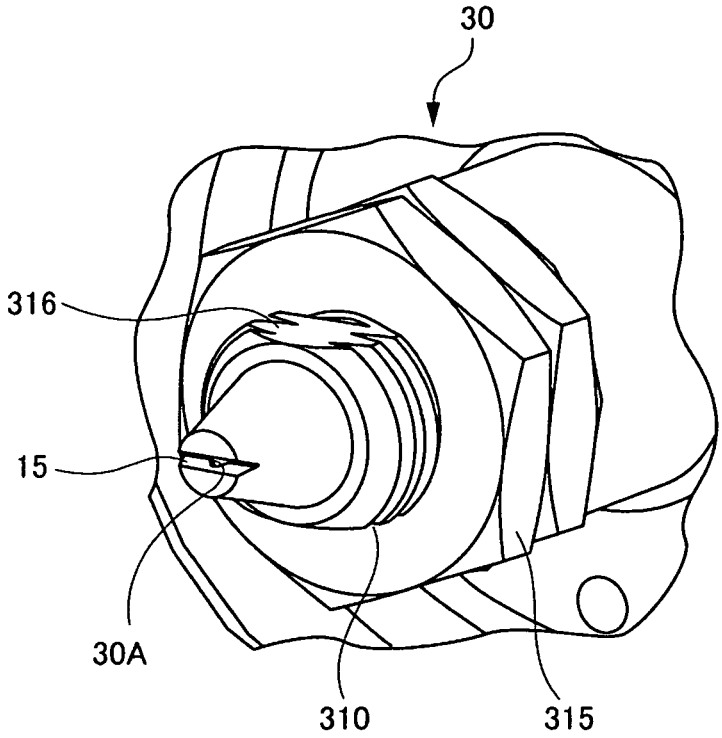
FIG. 11 is a configuration diagram of a coating material nozzle mounted to the spray gun according to a seventh embodiment of the present invention.

In the embodiments described above, it has been described that the groove 15 at the tip end portion of the coating material nozzle is configured in a crisscross arrangement viewing from a front side of the coating material ejection opening 30A. However, it is obvious that the present invention is applicable to a groove 15 formed in a straight line to pass through the coating material ejection opening 30A, as shown in FIG. 11, which is a front perspective view of the coating material ejection opening 30A. The groove 15 of the coating material nozzle shown in FIG. 11 is configured so that no air is introduced thereto. The groove 15, having a V shaped cross section, is formed as a part of the coating material ejection opening 30A so that a coating material passage is formed having an approximately lip shaped opening. As a result thereof, it is possible to form a spray pattern in a manner that the V shaped cross section forms a fan shaped coating material flow and the groove 15 spreads the coating material in elongated direction thereof.

<Eighth Embodiment>

In the embodiments described above, it has been described that the groove 15 of the tip end portion of the coating material nozzle has the V shaped cross section. However, it is obvious that the present invention is not limited thereto.

<Ninth Embodiment>

FIG. 12 is a configuration diagram of a coating material nozzle 80 mounted to a spray gun (gun main body) 1 according to a ninth embodiment of the present invention.

Figure 12A:
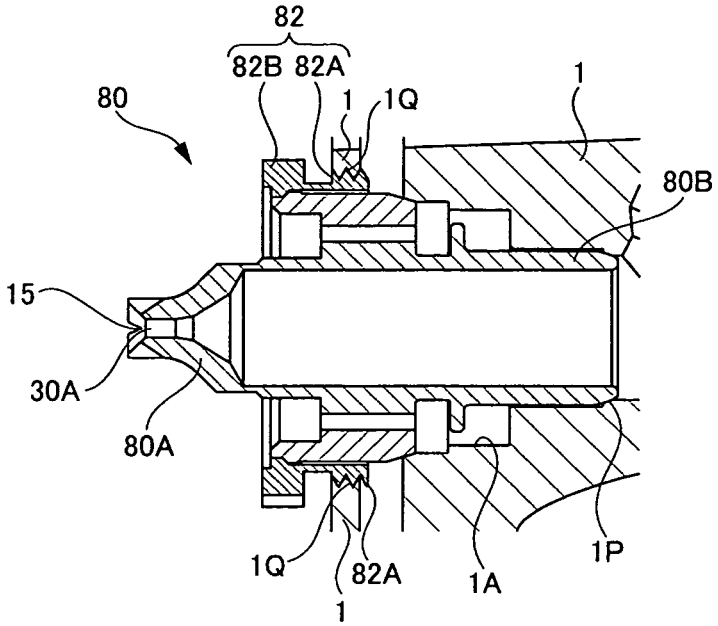
FIG. 12A is a cross sectional view of the coating material nozzle along a central axis thereof.
Figure 12B:
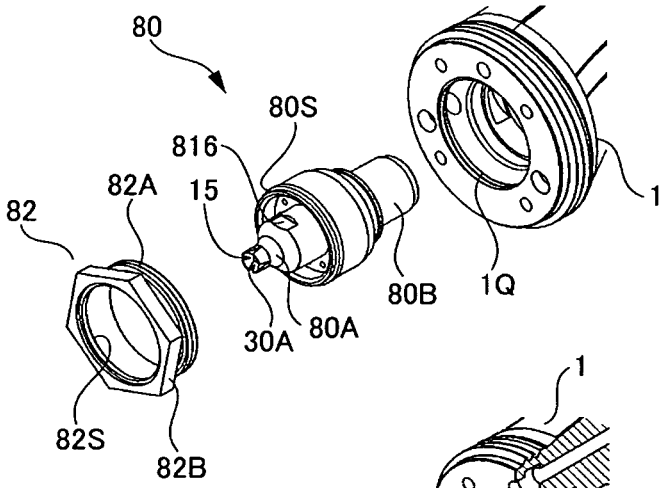
FIG. 12B is an exploded perspective view of the coating material nozzle.
Figure 12C:
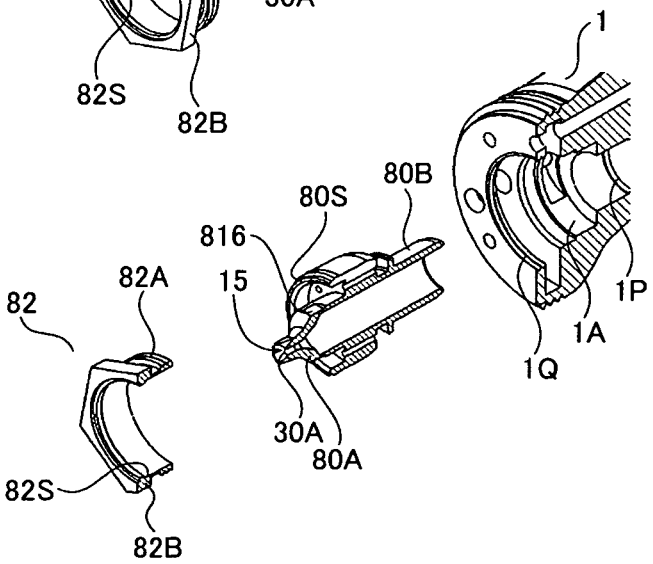
FIG. 12C is an exploded perspective cross sectional view of the coating material nozzle shown in FIG. 12B along the central axis thereof.

FIG. 12A is a cross sectional view of the coating material nozzle 80 along a central axis thereof. FIG. 12B is an exploded perspective view of the coating material nozzle 80. FIG. 12C is an exploded perspective cross sectional view of the coating material nozzle 80 shown in FIG. 12B along the central axis thereof.

Unlike the first to sixth embodiments, in the coating material nozzle 80 shown in FIG. 12, a tip end portion 80A thereof and a back end portion 80B thereof are not separately but integrally configured.

As shown in the first to sixth embodiments, the tip end portion 80A of the coating material nozzle 80 is formed with a coating material ejection opening 30A and a plurality of grooves 15, which increases in depth toward the coating material ejection opening 30A, on a periphery of the coating material ejection opening 30A.

The back end portion 80B of the coating material nozzle 80 is inserted in a hole 1A formed in the gun main body 1. The coating material nozzle 80 is arranged so that the tip end portion 80A thereof is exposed from the gun main body 1 by having the back end portion 80B abutted on a step portion 1P formed inside the hole 1A.

A nozzle seizing member 82 in a cylindrical shape is inserted surrounding the tip end portion 80A of the coating material nozzle 80 so that a thread groove 82A formed on an outer periphery of the nozzle seizing member 82 is screwed with an internal thread groove 1Q formed on a inner periphery of the hole 1A on a front side of the gun main body 1.

The nozzle seizing member 82 is formed with a hexagonal bolt portion 82B at a front end thereof for convenience in threading with the internal thread groove 1Q of the gun main body 1.

Furthermore, the nozzle seizing member 82 is formed on an inner peripheral surface thereof with an engaging portion 82S that engages an engaged portion 80S formed on a periphery of the coating material nozzle 80 on an occasion in which the nozzle seizing member 82 is inserted surrounding the tip portion 80A of the coating material nozzle 80 and screwed with the gun main body 1.

As a result thereof, the coating material nozzle 80 is fixed to the gun main body 1 in a manner that the coating material nozzle 80 is clamped between the nozzle seizing member 82 and the gun main body 1 (step portion 1P).

Subsequently, the coating material nozzle 80 is rotated around the central axis thereof by clamping a pair of clamped surfaces 816 formed on the tip end portion 80A of the coating material nozzle 80 using, for example, a wrench or the like. Thus, the grooves 15 of the tip end portion 80A of the coating material nozzle 80 are adjusted so as to be positioned to a proper position with respect to side air holes 19 of an air cap 16, for example, as shown in FIGS. 2B and 2C.

<Tenth Embodiment>

FIG. 13 is a configuration diagram of a coating material nozzle 90 mounted to a spray gun (gun main body) 1 according to a tenth embodiment of the present invention.

Figure 13A:
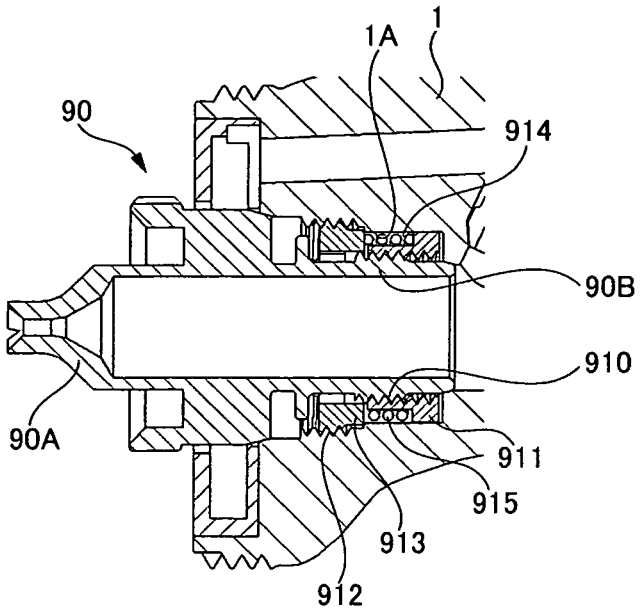
FIG. 13A is a cross sectional view of the coating material nozzle along a central axis thereof.
Figure 13B:
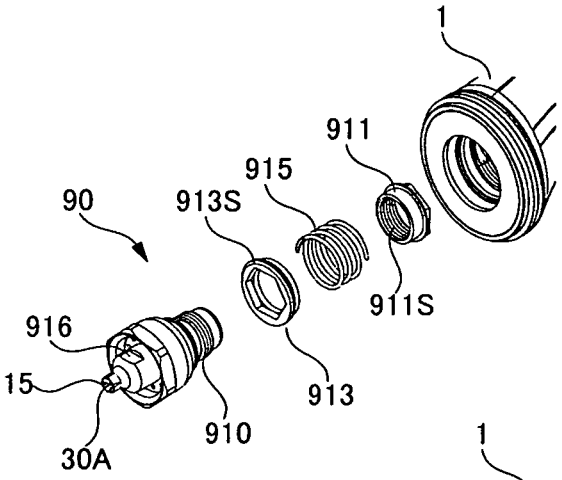
FIG. 13B is an exploded perspective view of the coating material nozzle.
Figure 13C:
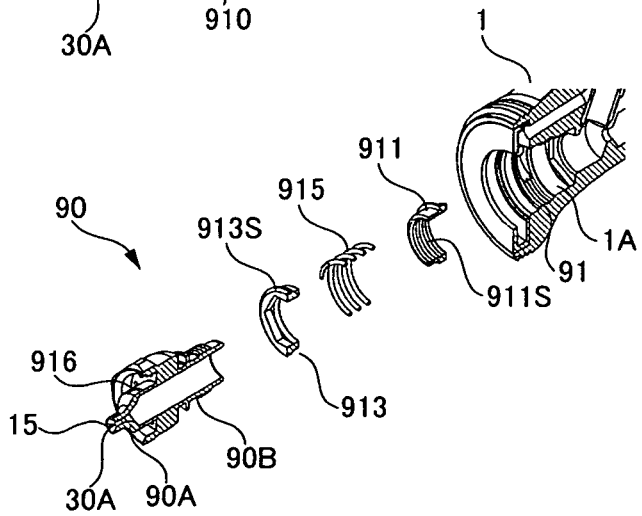
FIG. 13C is an exploded perspective cross sectional view of the coating material nozzle shown in FIG. 13B along the central axis thereof.

FIG. 13A is a cross sectional view of the coating material nozzle 90 along a central axis thereof. FIG. 13B is an exploded perspective view of the coating material nozzle 90. FIG. 13C is an exploded perspective cross sectional view of the coating material nozzle 90 shown in FIG. 13B along the central axis thereof.

As shown in the ninth embodiment, in the coating material nozzle 90 shown in FIG. 13, a tip end portion 90A thereof and a back end portion 90B thereof are integrally configured.

The back end portion 90B of the coating material nozzle 90 is inserted in a hole 1A formed in the gun main body 1. When inserted in the hole 1A of the gun main body 1, the coating material nozzle 90 is configured, at least at the back end portion 90B, to have a gap 914 with the hole 1A of the gun main body 1. The gap 914 is adapted to have arranged therein a first engaging member 911 that is screwed with a thread groove 910 formed on an outer periphery of the back end portion 90B of the coating material nozzle 90, a second engaging member 913 that is screwed with an internal thread groove 912 formed on an inner periphery of the hole 1A of the gun main body 1, and a compression spring 915 arranged between the first engaging member 911 and the second engaging member 913.

As shown in FIG. 13B, the first engaging member 911 is configured as an approximately cylindrical member formed with an internal thread groove 911S on an inner peripheral surface thereof. The first engaging member 911 is formed with, for example, a hexagonal portion shown in FIG. 13B on an outer periphery thereof as a rotation stopper at a time of threading the coating material nozzle 90 with the gun main body 1. The first engaging member 911 is adapted to be inserted in the hole 1A of the gun main body 1 and screwed with the thread groove 910 formed on an outer periphery of the coating material nozzle 90.

The second engaging member 913 is configured as an approximately cylindrical member formed with a thread groove 913S on an outer periphery thereof. The second engaging member 913 is adapted to be inserted in the hole 1A of the gun main body 1 and, as shown in FIG. 13A, screwed with the internal thread groove 912 formed on the inner peripheral surface of the hole 1A of the gun main body 1. The compression spring 915 is configured by a coil spring arranged surrounding the coating material nozzle 90 and is adapted to generate a force for the first engaging member 911 and the second engaging member 913 to separate from each other.

As a result thereof, the coating material nozzle 90 is fixed to the gun main body 1 by means of the compression spring 915 arranged between the first engaging member 911 fixed to the gun main body 1 and the second engaging member 913 fixed to the coating material nozzle 90.

Subsequently, the coating material nozzle 90 is rotated around the central axis thereof by clamping a pair of clamped surfaces 916 formed on the tip end portion 90A of the coating material nozzle 90 using, for example, a wrench or the like. Thus, the grooves 15 of the tip end portion 90A of the coating material nozzle 90 are adjusted so as to be positioned to a proper position with respect to side air holes 19 of an air cap 16, for example, as shown in FIGS. 2B and 2C.

It will be clear to those skilled in the art that both configurations shown in the seventh and eighth embodiments can be applied to both configurations of the ninth and tenth embodiments.

It should be noted that the present invention is not limited to the scope described in the embodiments described above. For example, material type of the first nozzle is not limited.

For example, the first nozzle may be made of resin, wear-resistant material, or the like. Furthermore, since the tip end portion of the first nozzle is separable, the tip end portion is exchangeable to that of different nozzle diameter and adjustable of positional relation between the first nozzle and the air cap.

It will be clear to those skilled in the art that modifications and improvements may be made to the embodiments described above. It should be noted that such modifications and improvements are included in the scope of the present invention.

REFERENCE SINGS LIST

1 Spray Gun (Gun Main Body)
1A Hole
1P Step Portion
2 Gun Barrel Part
3 Trigger
3A Fulcrum
4 Grip Part
5 Air Nipple
6 Air Passage
7 Air Valve Part
8 Valve Stem
9 Air Valve
10 Guide Chamber
11 Needle Valve Guide
12 Needle Valve
13 Coil Spring
14 Coating Material Joint
15 Groove
16 Air Cap
16A Horn Portion
17 Ring Shaped Slit
18 Air Cap Cover
19 Side Air Hole
20 Spread Pattern Adjustment Device
21 Pattern Adjustment Tab
30, 40, 50, 60, 60', 70, 80, 90 Coating Material Nozzle
30A Coating Material Ejection Opening
80A Tip End Portion (of the coating material nozzle 80)
80B Back End Portion (of the coating material nozzle 80)
80S Engaged Portion
82 Nozzle Seizing Member
82A Thread groove
82B Hexagonal Bolt Portion
82S Engaging portion
90A Tip End Portion (of the coating material nozzle 90)
90B Back End Portion (of the coating material nozzle 90)
310, 410, 510, 610, 710 First Nozzle
311, 411, 511 Large Diameter Portion
312, 412, 612 Ring Groove
313, 413, 613 O-ring
314 Thread groove
315 Nut
316, 416, 516, 616, 716, 816, 916 Clamped Surface
320, 420, 520, 620, 720 Second Nozzle
321, 421, 521, 621, 721 Thread groove
322, 422 Opening
323 Edge wall portion
423 Engaging portion
425 Internal thread groove
426 Ring Shaped Member
427 Screw Driver Groove
428, 528, 628, 619 Slip ring
510A Extension Portion
512 Stopper Ring
513 Ring Groove
614 Push Washer
614A Ring Material
614B Tooth
618 Spring
710A Back End Portion (of the first nozzle)
710P Open End (of the first nozzle)
712 Internal thread groove
714 Gap
715 Nut
715A Extension Portion
717 Thread groove
720A Large Diameter Portion
720S Step Portion
910 Thread groove
911 First Engaging Member
912 Internal thread groove
913 Second Engaging Member
914 Gap
915 Compression Spring

CITATION LIST

Patent Literature

Patent Literature 1: Japanese Unexamined Patent Application Publication No. 8-196950

Patent Literature 2: WO01/02099

The invention claimed is:

1. A spray gun comprising:

a gun main body;

a coating material nozzle attached to a gun barrel part of the gun main body and formed with at least one groove on a tip end portion having a coating material ejection opening; and an air cap disposed surrounding the coating material ejection opening of the coating material nozzle, introducing air to the at least one groove of the coating material nozzle, and having a side air hole for ejecting air to intersect with coating material ejected from the coating material ejection opening of the coating material nozzle, wherein the coating material nozzle is configured to adjust a position of the at least one groove around a central axis thereof a least at the tip end portion thereof, wherein the coating material nozzle comprises a first nozzle arranged on a side of the tip end portion and a second nozzle coaxially arranged on a side of a back end portion of the first nozzle, the second nozzle being screwed with the gun main body, and the first nozzle being connected to the second nozzle to adjust the position of the at least one groove around the central axis, wherein the first nozzle has a large diameter portion in outer diameter at a back end portion thereof, the outer diameter of the large diameter portion being larger than an outer diameter of a tip end portion of the first nozzle, and the second nozzle has an edge wall portion formed with a hole at an open end of a tip end portion thereof, and wherein the first nozzle is connected to the second nozzle in such a manner that the first nozzle is inserted to protrude through the hole of the second nozzle, and a fastener member is screwed with the tip end portion of the first nozzle, whereby the edge wall portion of the second nozzle is clamped between the large diameter portion of the first nozzle and the fastener member.

2. The spray gun according to claim 1, wherein the at least one groove comprises a plurality of grooves provided around the tip end portion of the coating material nozzle and along a circumferential direction of the tip end portion toward the coating material ejection opening.

3. A spray gun comprising:

a gun main body;

a coating material nozzle attached to a gun barrel part of the gun main body, and formed with a groove at a tip end portion having a coating material ejection opening; and an air cap disposed surrounding the coating material ejection opening of the coating material nozzle, having a side air hole for ejecting air to intersect with coating material ejected from the coating material ejection opening of the coating material nozzle, wherein the groove is formed on a tip end surface of the coating material nozzle in a straight line to pass through the coating material ejection opening, and wherein the coating material nozzle is configured to adjust a position of the groove around a central axis thereof at least at the tip end portion thereof, wherein the coating material nozzle comprises a first nozzle arranged on a side of the tip end portion and a second nozzle coaxially arranged on a side of a back end portion of the first nozzle, the second nozzle being screwed with the gun main body, and the first nozzle being connected to the second nozzle to adjust the position of the at least one groove around the central axis, wherein the first nozzle has a large diameter portion in outer diameter at a back end portion thereof, the outer diameter of the large diameter portion being larger than an outer diameter of the tip end portion of the first nozzle, and the second nozzle has an edge wall portion formed with a hole at an open end of a tip end portion thereof, and wherein the first nozzle is connected to the second nozzle in such a manner that the first nozzle is inserted to protrude through the hole of the second nozzle, and a fastener member is screwed with the tip end portion of the first nozzle, whereby the edge wall portion of the second nozzle is clamped between the large diameter portion of the first nozzle and the fastener member.

* * * * *